US009750962B2

(12) United States Patent
Margolin

(10) Patent No.: US 9,750,962 B2
(45) Date of Patent: Sep. 5, 2017

(54) FIRE PROTECTION CURTAIN

(71) Applicant: Adam Margolin, New York, NY (US)

(72) Inventor: Adam Margolin, New York, NY (US)

( * ) Notice: Subject to any disclaimer, the term of this patent is extended or adjusted under 35 U.S.C. 154(b) by 218 days.

(21) Appl. No.: 14/704,801

(22) Filed: May 5, 2015

(65) Prior Publication Data

US 2015/0306435 A1 Oct. 29, 2015

Related U.S. Application Data

(63) Continuation of application No. PCT/US2013/006811, filed on Nov. 4, 2013.

(60) Provisional application No. 61/722,409, filed on Nov. 5, 2012.

(51) Int. Cl.

| | |
|---|---|
| ***A62C 2/06*** | (2006.01) |
| ***A62C 2/10*** | (2006.01) |
| ***A62C 3/02*** | (2006.01) |

(52) U.S. Cl.

CPC ..... *A62C 2/10* (2013.01); *A62C 2/06* (2013.01); *A62C 3/0214* (2013.01); *A62C 3/0257* (2013.01)

(58) Field of Classification Search

CPC ..... A62C 2/06; A62C 2/10; A62C 3/0214; A62C 3/0257

See application file for complete search history.

(56) References Cited

U.S. PATENT DOCUMENTS

| | | | | | |
|---|---|---|---|---|---|
| 3,766,958 | A * | 10/1973 | Mitchell | E04B 1/941 | 160/1 |
| 4,858,395 | A * | 8/1989 | McQuirk | E04B 1/94 | 135/903 |
| 5,608,992 | A * | 3/1997 | Floyd | E04B 1/94 | 135/115 |
| 5,860,251 | A * | 1/1999 | Gleich | A62C 3/0257 | 52/2.18 |
| 5,966,877 | A * | 10/1999 | Hawes | E04G 21/30 | 52/3 |
| 6,401,487 | B1 | 6/2002 | Kotliar | | |
| 6,742,305 | B2 * | 6/2004 | Rogers | A62C 3/0214 | 160/23.1 |
| 2004/0035059 | A1 * | 2/2004 | Meyer | A62C 3/0257 | 52/1 |
| 2009/0242217 | A1 * | 10/2009 | van de Loenhorst | A62C 8/06 | 169/46 |
| 2009/0260838 | A1 * | 10/2009 | Jungermann | A62C 3/00 | 169/54 |

(Continued)

FOREIGN PATENT DOCUMENTS

| | | |
|---|---|---|
| RU | 2198351 C2 | 2/2003 |
| RU | 63967 U1 | 6/2007 |
| RU | 104674 U1 | 5/2011 |

*Primary Examiner* — Ryan Reis

(74) *Attorney, Agent, or Firm* — Dorsey & Whitney LLP

(57) ABSTRACT

A fire protection curtain having a curtain panel that includes an outer wall and a chimney defining an inlet disposed on a first side of the chimney and an outlet on another side of the chimney. The chimney is in heat conductive association with the outer wall such that heat from a source outside the outer wall is transmitted to the chimney. Such heat transmission can cause the chimney to draw air into the inlet and expel the air out the outlet by chimney effect. The curtain is flexible and sufficiently large for covering at least a portion of a structure to protect the structure from an external fire.

17 Claims, 21 Drawing Sheets

(56) References Cited

U.S. PATENT DOCUMENTS

2010/0294520 A1* 11/2010 Aguirre ..... A62C 3/0257
169/45

* cited by examiner

FIRE PROTECTION CURTAIN

CROSS-REFERENCE TO RELATED APPLICATION(S)

This application is a continuation-in-part of International Patent Application No. PCT/US2013/068311, filed on Nov. 4, 2013, which claims priority from U.S. Patent Application No. 61/722,409, filed on Nov. 5, 2012, the entire disclosures of which are incorporated herein by reference.

FIELD

The present disclosure generally relates to a device for protecting an object from a fire.

BACKGROUND

According to recent reports on wildfires, the average number of wildfires per year is about seven times greater than it was in the 1970s and result in large loss of property and houses. In some areas, evacuations are not uncommon due to wildfires, or a threat from a wildfire.

Various devices have been proposed to protect a structure from a wildfire. For example, U.S. Patent Publication No. 2008/0217028 discloses multiple panels connected together as a protective sheath made from a flame retardant material. U.S. Patent Publication No. 2010/0294520 proposes a fire shield having an expandable fabric material sandwiched between a coating. A problem with these systems is that heat can build up on both sides of the blanket, which can decrease the effectiveness of the fire shield.

Therefore, it may be beneficial to provide a fire shield system that can easily and effectively reduce the heat that can build up inside fire shield.

SUMMARY

An embodiment of a fire protection curtain includes a curtain panel with an outer wall and a chimney. The chimney defines an inlet disposed on a first side of the chimney and an outlet on another side of the chimney, which sides are preferably vertically spaced from each other. The chimney can be in heat conductive association with the outer wall such that heat from a source outside the outer wall is transmitted to the chimney, which heat causes the chimney to draw air into the inlet and expel the air out the outlet by chimney effect. The curtain can be flexible, and in typical applications, the curtain is sufficiently large for positioning near a structure to protect the structure from an external fire, such as a wildfire. In some embodiments, the protected structure may be a building, a vehicle, a fence, a utility pole, or a pile of wood.

The panel preferably also has an inner wall overlapping and spaced from the outer wall to define the chimney therebetween. A spacing element can be associated with the inner and outer walls to maintain a spacing therebetween to maintain the chimney open between the inlet and outlet. The spacing element is preferably disposed within the chimney, between the inner and outer walls and defines air-channels extending therethrough for maximizing airflow through the chimney.

The inner and outer walls are preferably flexible, and the spacing element can be resiliently compressible to enable rolling of the panel and expansion of the spacing between the walls upon unrolling of the panel or its placement about the structure. The spacing element can be made of a filament bundle having a high porosity to reduce restrictions to airflow. Suitable filament bundles include metal wool, such as steel wool.

The inner and outer walls can be made of sheets, such as metal foil, and the curtain can have many panels, typically sufficient to completely surround the protected structure. A common vertical support can be provided from which more than one of the panels disposed vertically with respect to each other is directly supported. The vertical support can be a cable or wire independently connected to a plurality of the panels.

In some embodiments, the inner wall includes a thermally insulative material. The outer wall is preferably made of a heat resistant material. In some embodiments, the material is highly heat conductive to maximize heat conduction into the chimney. In some embodiment, the spacing element can be configured to maximize heat conduction to air within the chimney for improving the chimney effect. In some embodiments, the spacing element can be made of a highly heat conductive material. The outer wall can be made of a metal foil material. In other embodiments, materials that are not highly heat conductive or that are insulative can be used. For example, in other embodiments, the spacing element can be made of a low heat conductive or insulative material. In some embodiments, one or more of the walls may be made of a low heat conductive or insulative material.

In some embodiments, the inlet is on an interior of the panel, and the outlet on an exterior of the panel. In some embodiments, the inlet and the outlet are both on the exterior of the panel. A one-way divider can be provided extending from the inner wall of a lower panel to an outer wall of a higher panel to define the outlet from the lower panel and the inlet of the higher panel. One-way dividers can be provided at the top and bottom of each of a plurality of some or all the panels, or of groups of panels, of the curtain to define the inlets and outlets thereof.

The fire protection curtain can be deployed around a structure by placing or looping a support element around the peak of the roof of a structure. The support element can be anchored to provide further support to the fire protection curtain, and a lining (e.g., a protection element) can be placed on a jutting portion of the roof to protect the fire protection curtain during hoisting over or about the jutting portion. Once the support element, and any protection elements, have been placed on the roof of the structure, the fire protection curtain can be hoisted up to the support element and unfurled (e.g., unrolled or unfolded) over the structure. In preparation to deploy the fire protection curtain, it can be unrolled horizontally at the base of the structure prior to being hoisted. A spreading arrangement can be connected to the fire protection curtain to aid in hoisting the fire protection curtain. A further fire protection curtain can be placed on the roof to cover any exposed portions.

The fire protection curtain can be deployed in a ready stage (e.g., hoisted on to the roof but not unfurled) upon receiving information about a wildfire, and the fire protection curtain can be unfurled in response to the information or the actual threat of a wildfire.

While multiple embodiments are disclosed, including variations thereof, still other embodiments of the present disclosure will become apparent to those skilled in the art from the following detailed description, which shows and describes illustrative embodiments of the disclosure. As will be realized, the disclosure is capable of modifications in various obvious aspects, all without departing from the spirit and scope of the present disclosure. Accordingly, the drawings and detailed description are to be regarded as illustrative in nature and not restrictive.

BRIEF DESCRIPTION OF THE FIGURES

While the specification concludes with claims particularly pointing out and distinctly claiming the subject matter that is regarded as forming the present invention, it is believed that the disclosure will be better understood from the following description taken in conjunction with the accompanying figures, in which:

FIG. 16B shows a first embodiment of a fire protection curtain on a pile of wood;

DETAILED DESCRIPTION

The present disclosure relates to a novel and advantageous fire protection curtain or blanket having improved heat dissipation and fire protection that may be configured to cover objects such as, among other things, fixed structures (e.g., residential and commercial buildings, utility structures (e.g., a utility towers or poles, such as a cellular towers or telephone poles), fences, large wood piles, sculptures, monuments or historical landmarks etc.), and/or movable structures (e.g., vehicles, chairs, etc.).

Figure 1A:
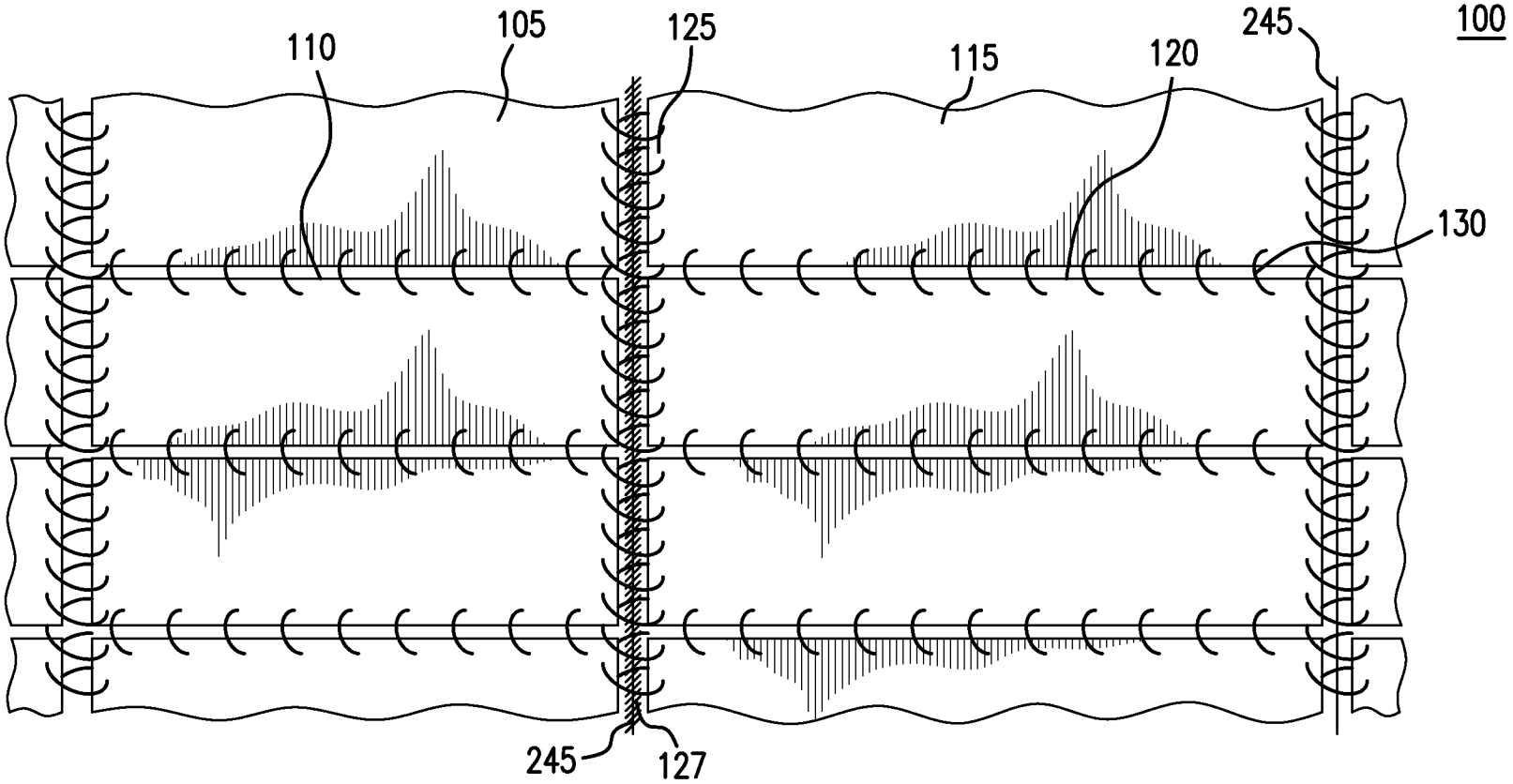
FIG. 1A is a front view of an exemplary fire protection curtain.

As depicted in FIGS. 1 A-B, fire protection curtain 100 is shown protecting building 150 from an encroaching fire. Fire protection curtain 100 can include of a plurality of panels connected together such as panels 105, 110, 115 and 120. Panel 105 can be connected to panel 110 on one side, and connected to panel 115 on another side. Similarly, panel 115 can be connected to panel 120 on one side and to panel 105 on another second side.

Figure 1B:
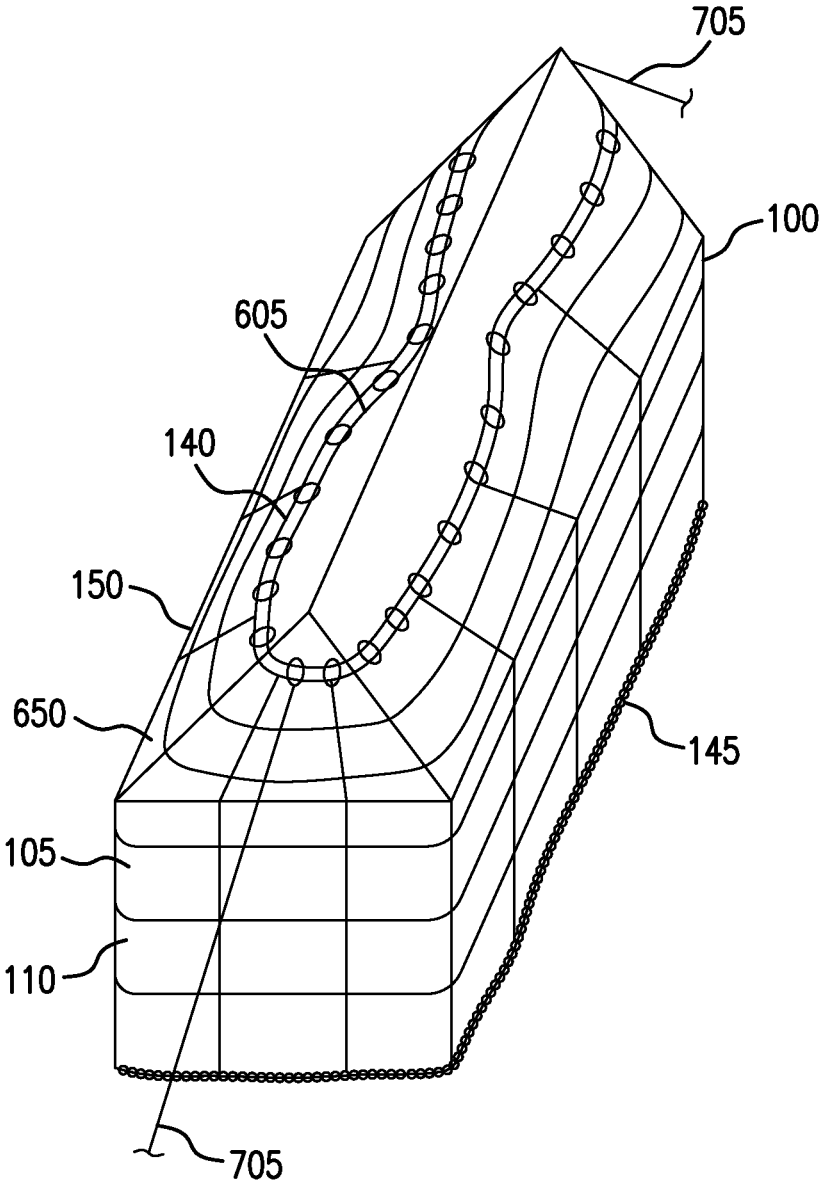
FIG. 1B is a perspective view of the fire protection curtain of FIG. 1A mounted on a structure.

Fire protection curtain 100 is configured to surround a structure to protect the structure from a fire. In FIG. 1B, top side 140 of the fire protection curtain is used to hang fire protection curtain 100 from a hanging support, discussed below, from to the roof of structure 150. The bottom side of curtain 100 can lay on, held to, or be secured to, the ground to form an enclosure around structure 150. Fire protection curtain 100 is preferably composed of a suitable number of panels having of suitable size to provide flexibility to the assembled fire protection curtain 100 and sufficiently cover the structure to be protected. Typical panels are rectangular and measure between about 1 and 30 feet per side, although other arrangements are possible. In one embodiment, panels are about 20 feet wide by 3 feet high. For example, panels may be about 50 feet wide and 2 feet high. The number of panels in a curtain can be selected depending on the size of the structure or portion thereof to be protected. Additionally, the panels can be linked together to form larger curtains, and additional curtains can be added even after fire protection curtain 100 has been deployed. Fire protection curtain 100 can have discreet ends, similar to a blanket, as seen in. Alternatively, fire protection curtain 100 can be connected to each other in a continuous loop.

Figure 2B:
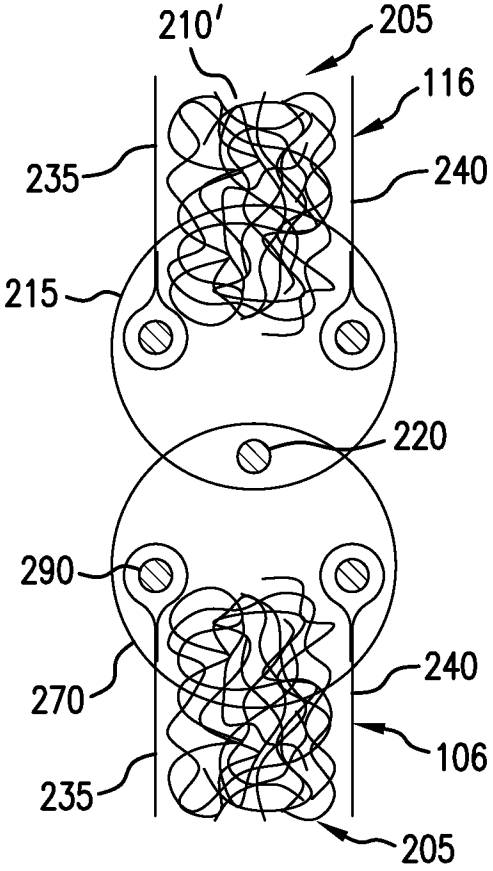
FIG. 2B is a cross-sectional view showing a connection between panels of a fire protection curtain.
Figure 2A:
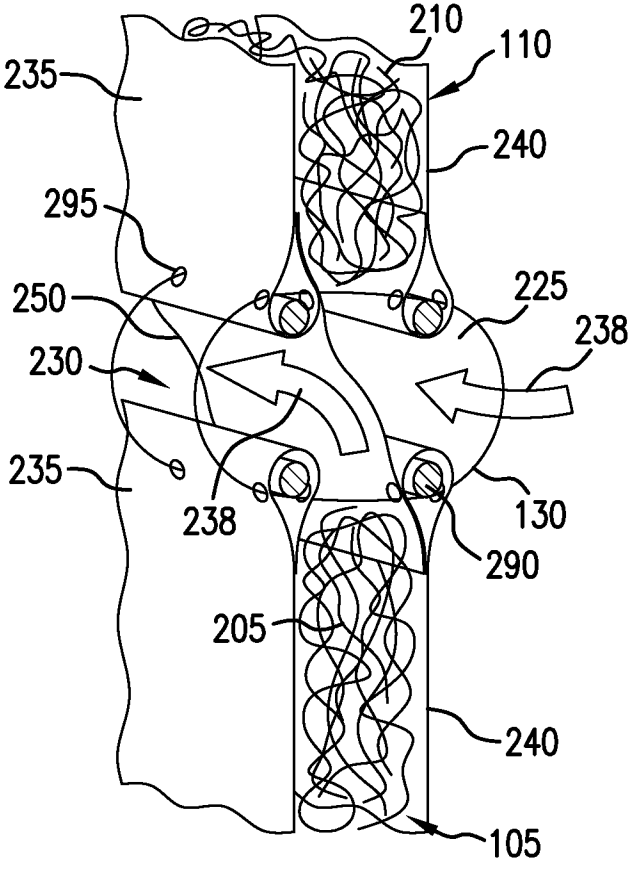
FIG. 2A is a cut-away-sectional view of a plurality of the fire protection panels of the fire protection curtain of FIG. 1A.

As depicted in FIGS. 2A-B, an embodiment of the fire protection curtain 100 has a plurality of panels 105 and 110. Panels 105 and 110 can each include two or more walls 235, 240. Wall 235 in this embodiment is an outer wall providing the outer layer of the fire protection curtain 100. As such, fire protection curtain 100 is mounted to the structure 150 with the outer wall 235 of the panels 105 and 110 disposed on an outer side of fire protection curtain 100 facing away from the structure 150 preferably not contacting the structure 150 being protected over all, almost all, or the major part of fire protection curtain 100. Wall 240 in this embodiment is an inner wall providing the inner layer of fire protection curtain 100. As such, in practice, fire protection curtain 100 is mounted to the structure 150 with the inner wall 240 facing towards the structure 150.

Inner and outer walls 235, 240 are preferably made of a flexible material to enable rolling and unrolling of the curtain and conforming to the shape of the underlying structure. Suitable materials include a foil, which is preferably made of a metal or other highly heat-reflective material.

In some embodiments, a reflective coating, for instance, can be provided to reflect radiant heat from the external surface of the curtain. Some alternative embodiments can have exterior surfaces with lower heat-reflective properties, however. Thermally conductive or insulative materials can be selected. In one embodiment, 321 stainless steel foil is used for both walls 235 and 240 with a thickness of between approximately 0.002 to 0.004 inches. The material of the walls 235, 240 can be abrasion resistant and can be temperature resistant or fireproof to withstand repeated high temperature exposures and mounting and retrieving from structures. Typical materials include foils, cloths, or other thin sheet materials of stainless or non-stainless steel, other metals or alloys such as inconel, monel, hastelloy, or can be made from woven or non-woven material including ceramics, silica's, Nextel, nomex, Kevlar and other synthetic material. Additionally, carbon and non-carbonized materials, polyester thermoplastics and other temperature resistant materials can be used.

Outer wall 235 can be made of a thermally conductive material, to transmit heat from the fire external to the structure into a chimney in the space between the walls 235 and 240. The inner wall 240 can be made of a thermal insulating material, such as fiberglass, carbon, ceramic or plastic, to limit the heat transferred across fire protection curtain 100, or alternatively of a thermally conductive or highly conductive material. Alternatively, both the inner and outer walls can be made of thermal insulating material. The outer wall 240 is offset from the inner wall 235 such that inner wall 240 is in a different plane than outer wall 235, superimposed over each other. The walls 235 and 240 can be flat, curved, wrinkle, or warped and can take on other shapes, for instance as they are laid on the structure. Portions of the sheet material of on wall can cross over to the other wall or to its other plane.

This offset defines a chimney in the space 205 between the inner wall 235 and outer wall 240. Buoyancy of the air in the chimney can occur due to a difference in the air density between the walls, on the inside of the chimney 205, and the air on the outside of fire protection curtain 100, resulting from heating the air in the chimney 205. With a greater thermal difference, a greater buoyancy force can be achieved. In this manner, a chimney effect is created. The space 205 defined between outer wall 235 and inner wall 240 is typically between approximately 1 and 4 inches, although larger or smaller spaces can be utilized depending on the size and shape or the structure and the amount of flexibility required of the curtain for storage and/or mounting on the structure.

Outer wall 235 and inner wall 240 can be connected by a one-way divider, such as foil 250, which can separate an inlet 225 on the inside (structure side) and an outlet 230 on the outside of fire protection curtain 100 between walls of different panels. Alternatively, inlet 225 and outlet 230 can both be on the outside, in the outer wall 235 of fire protection curtain 100, optionally with the inner wall substantially closed. Other one-way flow valves can be used, and some embodiments do not employ a one-way flow foil, for example, relying solely on the pressure difference caused by the difference in temperature on either side of fire protection curtain 100 to draw air in the bottom side of each panel, acting as an inlet, and exhaust it out the top side, acting as an outlet (e.g., FIG. 2B, with the gas flow shown by arrows 238 through inlets and outlets that are separated from each other). Regardless of whether a one-way flow mechanism is used, the inlet is typically lower than the outlet for chimney effect to flow the air out of the curtain.

When fire protection curtain 100 is deployed, air enters the chimney 205 via the inlet 225 and exits from the outlet 230 of the chimney. The chimney effect can facilitate the reduction of heat in on the structure side of the curtain, and around the structure, as well as in the curtain as well, significantly increasing the thermal insulative properties of the curtain and its longevity.

Figure 2C:
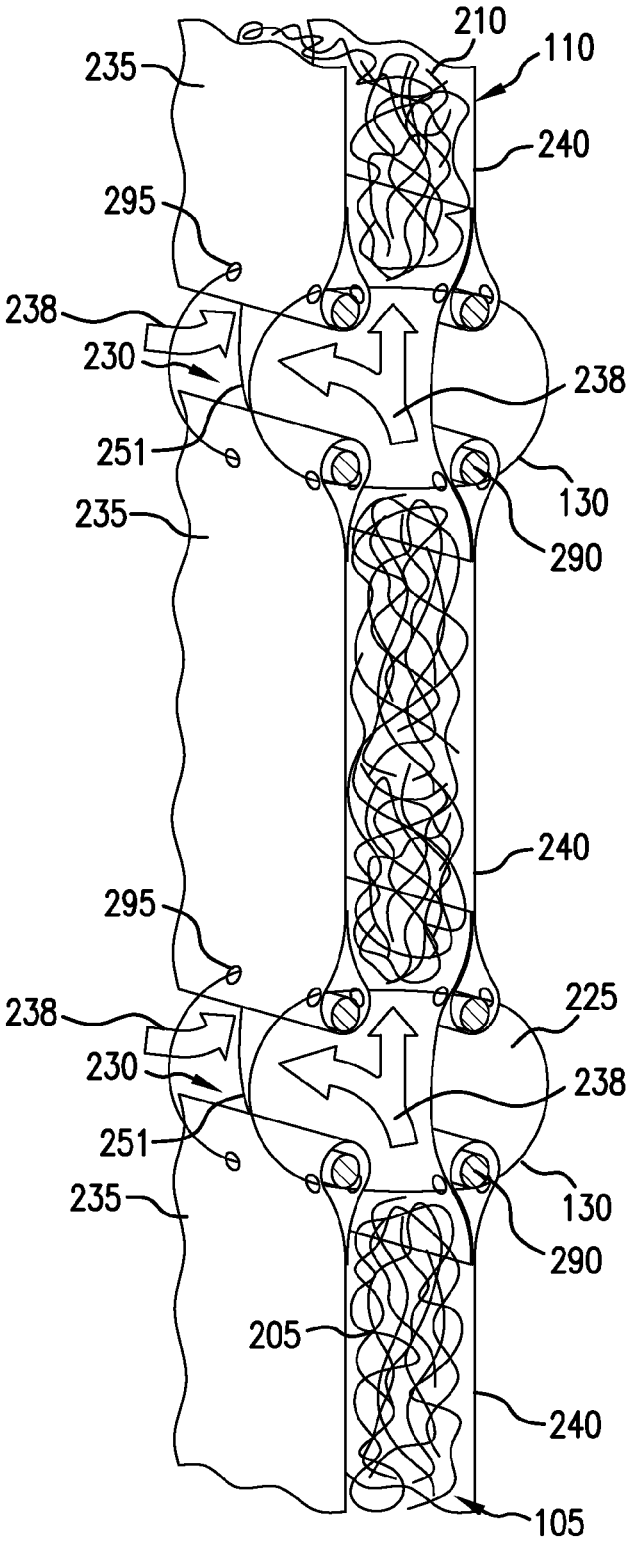
FIG. 2C is across-sectional view of another embodiments of fire protection panels of a fire protection curtain.

FIG. 2C shows an embodiment in which a barrier, such as foil 251 closes off the openings between the vertically adjacent inner wall panels. The spaces between vertically adjacent outer wall panels are left open. This is one way of providing an inlet and outlet to the chimney that are both on the outer wall 235. The inlet and outlet of this embodiment are configured as a combined inlet/outlet, although other embodiments have a separated independent inlet/outlet arrangement, in which the openings that form the inlets are separated from those that form the outlets.

One-way flow foil 250 can be integrated with outer wall 235 and inner wall portion 240 such that panel 105 is composed of a single continuous sheet of material. Walls can be overlapping but offset to provide a lip at one or both ends that connects to the lip of the vertically adjacent panel. Alternatively, one-way flow foil 250 can be a separate piece joining outer wall 235 to inner 240. One-way flow foil can be connected to outer wall 235 and inner wall 240 using any suitable connection (e.g., a pop rivet or a weld).

Fire protection curtain 100 can have a spacing element 210 located in space 205 between outer wall 235 and inner wall 240. Spacing element 210 can have resilient, spring-like characteristics and can be compressed and re-expand under its own energy to spread the walls apart to open the chimney. Spacing element 210 can be made of wide flat springs and/or a material that can expand due to an increase in heat to open the chimney 205 as more heat is introduced therein. Suitable materials include porous material (such as filament bundles) that allow high fluid flow therethrough, such as metal wool (e.g. steel wool) or springs or other suitable material and elements. In one embodiment, spacing element 210 can take the form of coil springs. Preferred spacing elements have high porosity to define air channels extending therethrough to allow airflow therethrough and minimize restriction thereof.

The spacing element 210 can be thermally associated with or insulated from the outer wall 235. Heat transferred from the outer wall 235 to the air in the chimney 205 increases the chimney effect.

Panels 235 and 240 can be connected to each other using a connection element 130 which can take the form, for instance, of a coil (such as of wire), rings, clips, or fasteners. Connection element 130 can pass through both ends of panel 105, passing through outer wall 235 and inner wall 240, or can attach to another portion of the panels or curtain, preferably at the top side 140 thereof. In some embodiments, to prevent tearing of the panels and walls 235, 240 by the connection elements 130, reinforcements 295, such as grommets or other suitable elements, can be integrated into holes in walls 235 and 240. In some embodiments, when metal foil walls are employed, the holes can be created, for instance, using a wheel punch or other similar method for making a hole. Alternatively or additionally, one or both ends of walls 235,240 can be wrapped around a horizontal support 290, which can take the form of a wire or cable, for example. A typical steel wire thickness for support 290 is about 0.06 to 0.3 inches (e.g., 0.4 to 0.3 inches), with a coil pitch of about ½ to 2 inches, and a diameter of about 1 inch to about 3 inches, although other sizes can be selected. In some embodiments, the holes may be a part of the material (e.g., the material may be a mesh material, such as a wire mesh material). For example, the walls may be attached (e.g., welded) so that wire joiners are not required. In some embodiments, the folded-over portion of the walls 235 and 240 can be affixed to the main portion of the walls by suitable methods, including adhering, welding, or fastening, or can be held in place by connection element 130. Connection element 130 can then be supported by horizontal support 290, which can spread the force over the entire top or bottom edges of the walls to prevent or reduce tearing.

The alternative embodiment of FIG. 2B uses two horizontal connecters to connect the vertically adjacent panels. An upper horizontal connector 215 extends around the horizontal supports 290 of panel 116 and a second horizontal connector 270 wrapping around the horizontal supports 290 of panel 106. Another horizontal support connector 220, such as a cable or a wire is strung through the loops of connectors 215 and 270 to hang the lower panel 105 from the upper panel 110. Inter-panel connectors 130 are preferably flexible and have a high tensile strength. Steel or synthetic wire or cable is suitable, for example. The arrangement of this figure can be used between larger groups of wall panels that are connected in another manner, such as shown in FIG. 2A. Variations of connection methods can be used within a single curtain, in some embodiments.

Vertical inter-panel connection elements 125 can be used to connect horizontally adjacent panels, such as panels 105 to 115. Similar elements can be used for the vertical connection elements 125 as for the horizontal connection elements 130, such as a coil looped between panels 105 and 110, and panels 115 and 120.

A filler material 127 can be placed between horizontally adjacent panels (e.g., between panels 105 and 115, and between panels 110 and 120), such as within the loops of the coil of the vertical connection element 125, to block or impede airflow between the space horizontally between the panels and the chimney 205 or from the outside to the inside of the curtain 100. This improves the efficiency of the chimney and helps decrease thermal transfer across gaps within the curtain 100. A foil or other air blocking or thermal insulating layer can alternatively be used across the gaps.

The fire protection curtain 100 can have its panels arranged in a plurality of rows and columns that collectively surround and/or cover and protect the structure. As each panel can be directly attached to and supported from the panel above it, in some arrangements, panels can bear the weight of all of the panels below them. Therefore, in order to provide greater vertical strength, some embodiments use a common vertical support 245, preferably connected to and supported from the top of the upper panels or from the element from which the curtain 100 itself is hung, such as upper support cable 605. Each panel, or groups of panels, can be attached independently to the common vertical support 245 to decrease the tension on the upper panels. The common vertical support 245 typically is a wire or a cable or other flexible member with high tensile strength. Common vertical supports can be located between panels, or over, behind, or through the panels, and are preferably connected to the upper side of each panel, such as to horizontal wires 290. In one embodiment, common vertical supports are provided every 1-3 feet apart to spread the support points.

Vertical supports 245 can be connected at their lower ends to a perimeter weight mechanism (e.g., chains, cables, weights, sand, or stone, such as laid on the ground), which can help keep fire protection curtain 100 from moving around due to wind or other weather, or to parts of the structure or other elements from which fire protection curtain 100 is hung. The perimeter weighting can be flexible, such as chain 145 or other weights along the bottom edge of the curtain 100, which is preferably flexible to follow the contours of and retain the curtain against the terrain adjacent the bottom of the curtain. The perimeter weighting is preferably heavy enough to move the material to close significant gaps between the curtain 100 and the ground and/or keep wind from blowing open a gap, moving the curtain out of a protective position, or otherwise significantly passing the curtain from underneath. Additional connector cables 607 or other supports can tie portions of the upper support cable to help spread the load of the hanging curtain 100.

Figure 3:
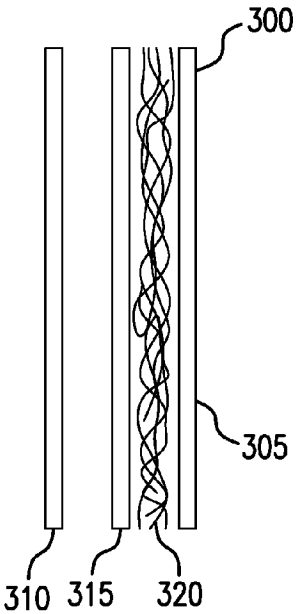
FIG. 3 is a cross-sectional view of a fire protection panel of a fire protection curtain having more than two layers.

As depicted in FIG. 3, a cross-sectional view of fire protection curtain 300 having more than two walls or layers is shown. The fire curtain 300 of this embodiment can have an outer layer 305, an inner layer 310, and a middle layer 315. Fire protections curtain 300 can further have spacing element 320, which can be located between one or both of layers, i.e., between layers 305 and 315 and/or layers 315 and 310. The additional walls or layer can add an additional thermal barrier between the encroaching fire and the structure to be protected, and in some embodiments provide additional chimney space. The inner layer 305 can be of a tough material or a mesh, and the middle layer 315 can be made of similar or different materials than the outer and inner layers 305,310.

Figure 4:
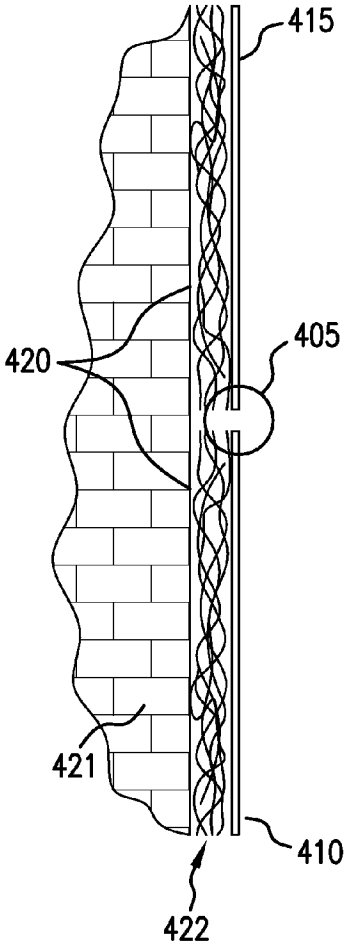
FIG. 4 is a cross-sectional view of a portion of a fire protection panels of another embodiment of a fire protection curtain.

As depicted in FIG. 4, a cross-sectional view of a fire protection curtain 100 having a single, outer wall is shown. Fire protection curtain 100 can have a plurality of panels 410 and 415 having a single wall or layer. On the inside (the side facing the structure) panels 410 and 415 can have spacing material 420 which can keep the outer wall spaced from the structure 421 to maintain an open chimney 422.

Figure 5:
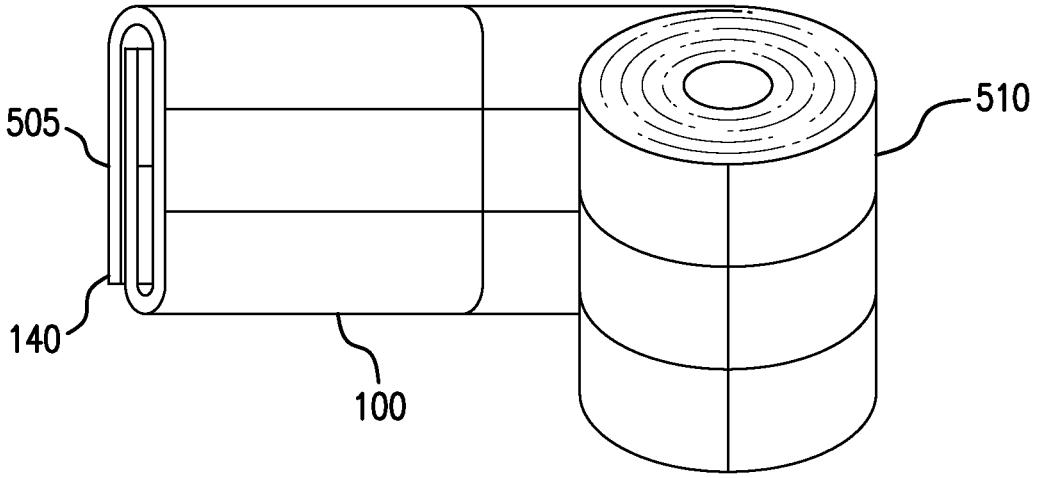
FIG. 5 is a perspective view of the fire protection curtain of FIG. 1A in a rolled up configuration.

As depicted in FIG. 5, fire protection curtain 100 is shown in a compact, undeployed configuration, which in this embodiment is folded and rolled up into a relatively small package, such as for transportation or storage. To fold up fire protection curtain 100, the fire protection curtain 100 of the preferred embodiment is folded in one direction and then rolled up in another. It can be folded or rolled in to a ribbon 505, for example, to decrease the vertical size of the curtain 100, forming horizontal fold lines, and then rolled in the horizontal direction, along a vertical axis into a roll 510. Alternative embodiments can be rolled in a single direction a single time, folded or rolled additional times in one or more directions and over axes extending in one or more directions, or can be made compact in other manners.

Figure 10:
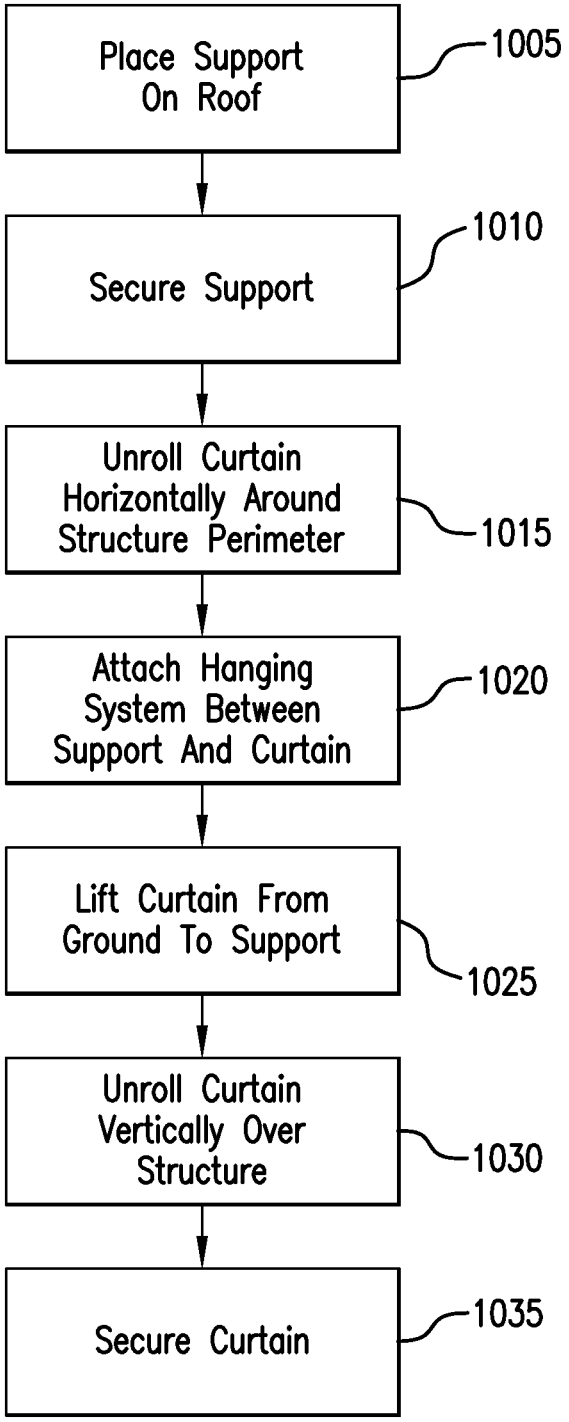
FIG. 10 shows an exemplary flow diagram for mounting the fire protection curtain on a structure.

With reference also to FIG. 10, when fire protection curtain 100 is deployed (step 1000), fire protection curtain 100 can be horizontally unrolled from roll 510 and can be laid around the structure to be protected (step 1015). Fire protection curtain can alternatively be unrolled in different directions (e.g., other than horizontal), and placed around the structure being protected. Then, fire protection curtain 100, preferably still folded or rolled upon itself as a ribbon 505, can be lifted to an elevated position on the structure (step 1025). Once the upper side of the curtain is secured around the structure, the curtain 100 can be unrolled vertically to cover the structure (steps 1030 and 1035). Fire protection curtain 100 can also be unrolled or deployed over the structure 150 in other manners or directions (e.g., not vertical). This allows lifting of the curtain while in a partially rolled, compact, condition and later unfurling the curtain once it is in supported in operational position on the structure, which can be advantageous for deployment during high winds, which are commonly associated with large wildfires.

Alternatively, the curtain can be unrolled and unfolded more or completely before lifting onto and hanging from the structure.

Figure 6:
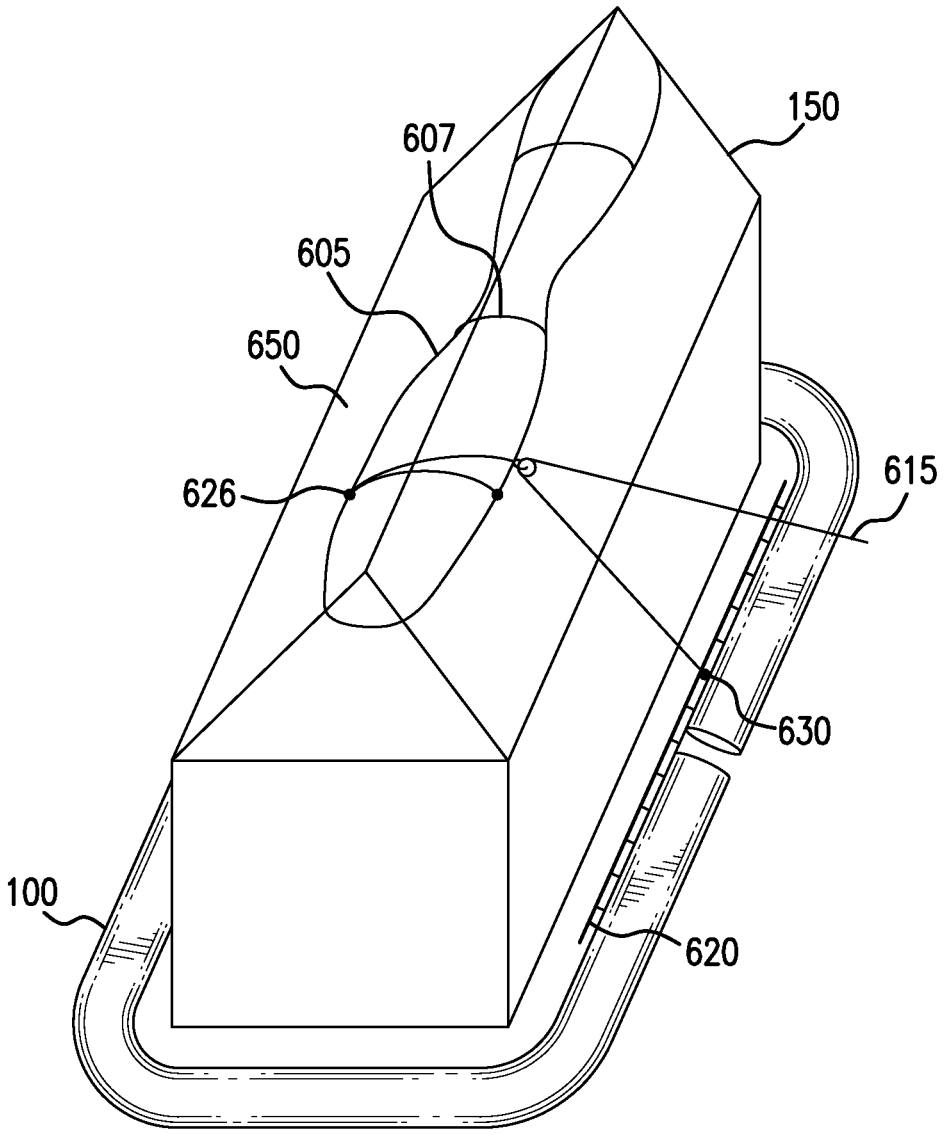
FIGS. 6 and 7A show the fire protection curtain of FIG. 5 being deployed around a structure and hoisted onto the structure's roof.
Figure 7A:
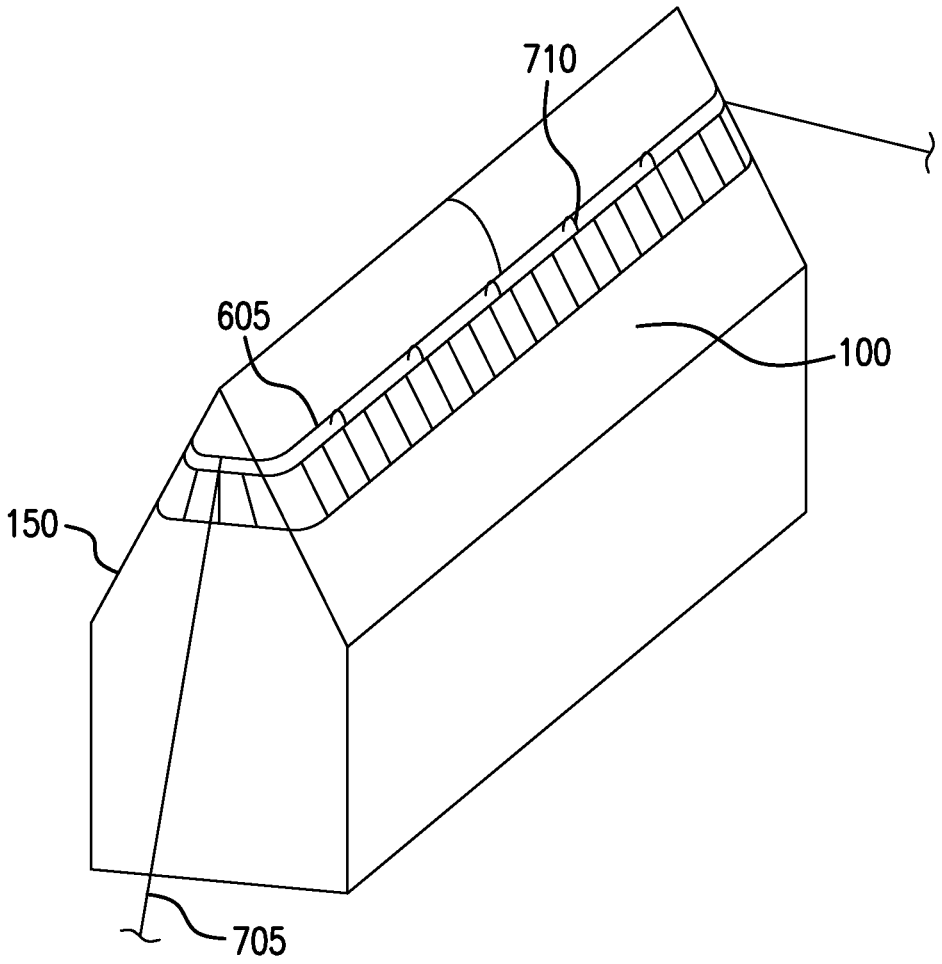
Figure 7B:
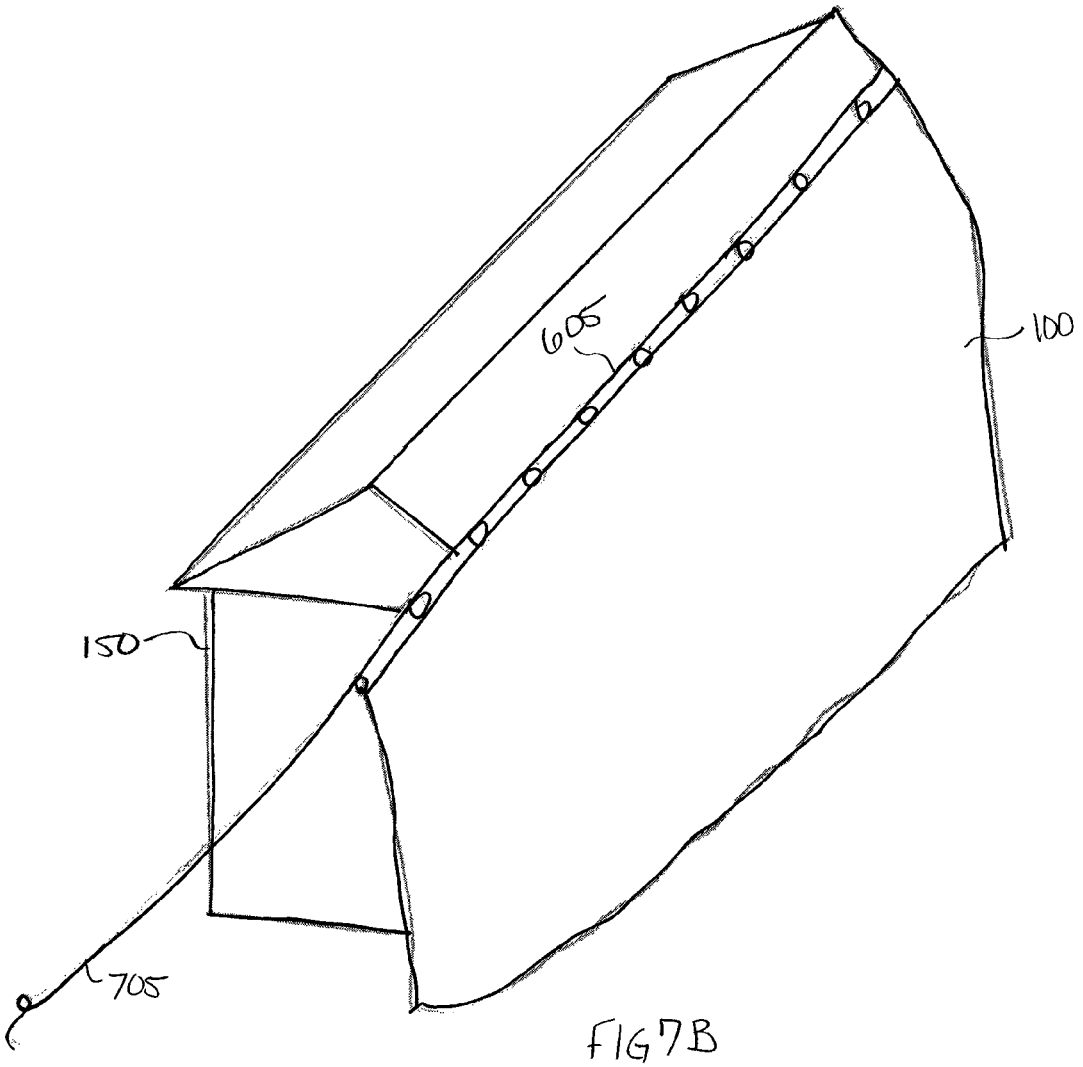
FIG. 7B shows a fire protection curtain covering a portion of a structure.

As depicted in FIGS. 6, 7A, and 7B, fire protection curtain 100 is shown being deployed to protect a structure 150. In order to deploy fire protection curtain 100 in this embodiment, a hanging support 605, which can take the form of a cable or a wire, for instance, is placed on an elevated portion of the structure, such as the roof 650 (step 1005). Hanging support 605 can be laid around the entire roof 650 of the structure 150, near the top of the roof 650, and is preferably sized to lie on the roof 650 without falling off. In the embodiment shown, the hanging support 605 is a loop of cable placed around the ridge of a gabled roof 650 and is initially stabilized by gravity. Hanging support 605 is of a material and configuration with suitable thickness (e.g., ½ inch thick steel cable) and is rated for a suitable weight (e.g., over 20,000 lb. where the structure is the size of a house). Suitable anchor lines, including anchoring arrangement 705, are preferably used to anchor the hanging support 605 to the ground, and can include stakes 1130, augers or other suitable anchoring mechanisms (step 1010 of FIG. 10). Alternatively, hanging support 605 can be anchored to structure 150 or to another structure.

Other embodiments can use a mounting system that feeds the support cable progressively around the roof and/or lifts the support cable onto the roof, such as by pulling the cable about the pre-installed mounting system, with or without the curtain preattached. Such an embodiment can be provided with another line attached to the support cable and accessible from the ground to enable a user to pull and mount the support cable, or other hanging support, onto the roof from the ground, or otherwise without needing to climb onto the roof. Other methods of positioning and attaching the support to the roof or other structure can be envisioned.

Lifting members, such as straps 615 can be attached to hanging support 605 and can be anchored to the ground, the hanging support, or other suitable object. Lift spreaders, such as spreader bar 620 can be connected to the top of the rolled-up fire protection curtain 100 or strapped around it, extending horizontally to aid in the lifting of fire protection curtain 100. This can decrease the number of lift point needed to lift the curtain onto the roof 650 and can help protect the curtain 100 on the way up. Typically, the spreader bar 620 is attached to the top of fire protection curtain 100 at multiple locations, and optionally at some or all of the locations at which fire protection curtain 100 is to be hung from the hanging support 605, including, for example to vertical supports 245. A hoisting system 626 (e.g., hook and pulley, block and tackle, hoist, and/or winch systems, and which can be powered or manually operated) can be attached to fire protection curtain 100 or spreader bar 620 at one or more locations 630, and can be used to hoist up fire protection curtain 100 (step 1020). The spreader bar 620 can be removed once fire protection curtain 100 is attached to the hanging support 605, or alternatively, it can be left on fire protection curtain 100, the spreader bar 620 itself remaining hanging or otherwise supported by the hanging support 605.

Figure 8:
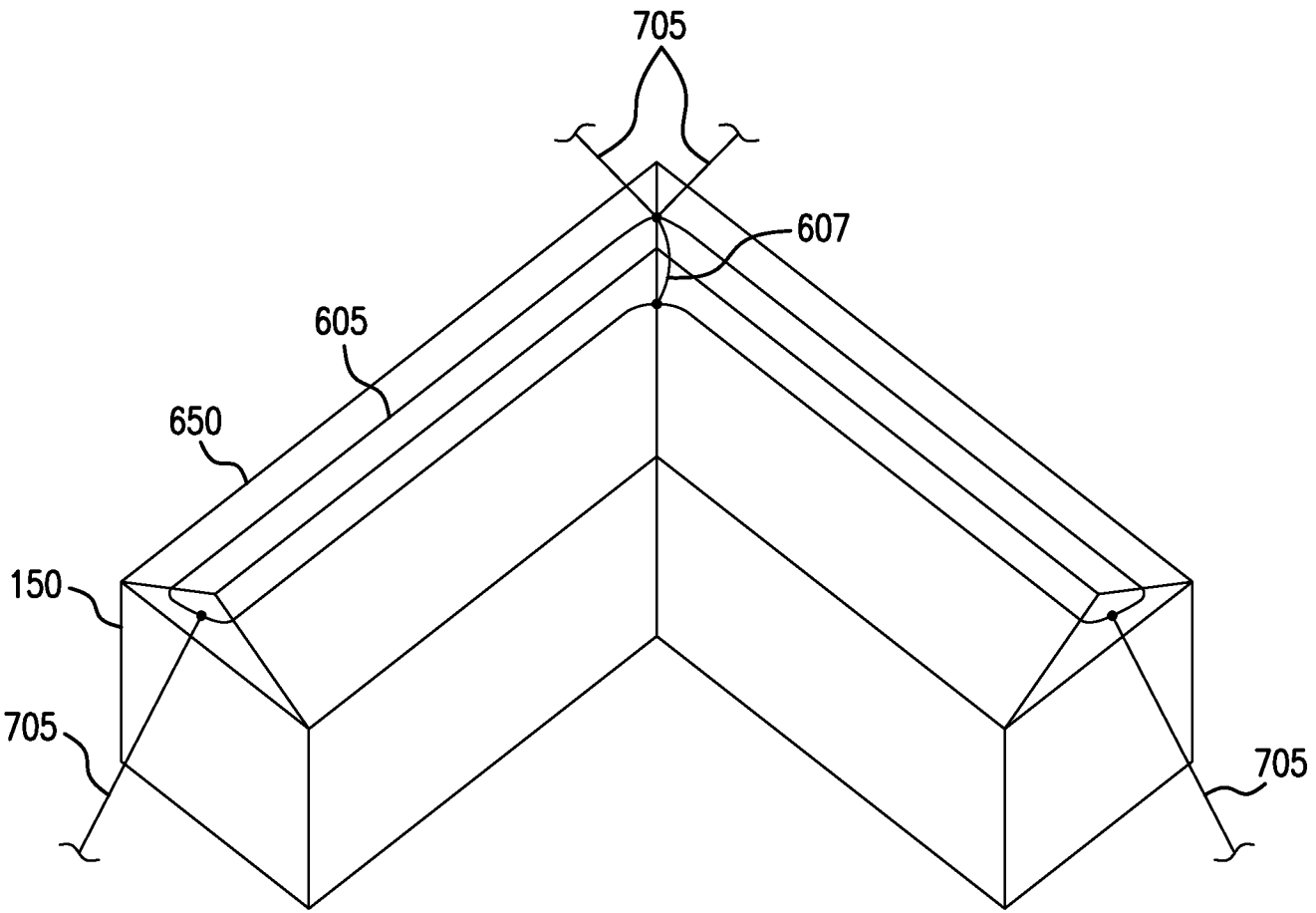
FIG. 8 shows steps in deploying a fire protection curtain on an L-shaped structure.

Once fire protection curtain is unrolled from roll 510 about the structure 150, as shown in FIG. 7A, it can be hoisted on to roof 650 or other part of structure 150, as shown in FIG. 8. Fire protection curtain 100 can be hoisted up using a motorized or non-motorized method and can be held on the structure 150 by attachments mechanism 710 that can be connected to hold lift bar 620 or the curtain 100 directly. Suitable attachments include hooks, carabineers, etc. In other embodiments, fire protection curtain 100 can be lifted using a crane, forklift, telehandler, ladder lift or other similar equipment. Fire protection curtain 100 can be hoisted up in a rolled or unrolled form. A protection element, such as tarps made of polycarbonate or other suitable materials, can be placed over corners on the structure 150, such as roof edges or chimneys, to protect the curtain or lubricate the ascent of the curtain 100 as it is raised over the structure 150 or its unfurling thereover. As shown in FIG. 1B, after fire protection curtain 100 is hoisted on to roof 150, it can be unrolled to protect the structure from direct contact with wild fires, other fires, or from the radiant energy emitted from a wildfire (step 1030). Additional curtains 100 or other elements can be employed to cover otherwise exposed portions of the structure, such as the peak of the roof 150.

Fire protection curtain 100 can be held up using a waist belt drawn around part or the entire curtain to hold it in place at a point below the support cable and above the ground. Additionally, a toe belt can be drawn around part or all of fire protection curtain 100 to hold it in place near to the ground. Support loops and/or arches can be attached to the support cable to minimize drooping of fire protection curtain 100.

The Exemplary fire protection curtain 100 can be deployed on buildings and other large or small structures of various shapes, planforms, and heights and sizes and can work around roof penetrations and obstacles such as chimneys, vents, antennas, satellite dishes, wind turbines, solar panels, air-conditioning units and trees. The fire protection curtain can be rapidly deployed, without the need to pre-modify the structure for the curtain. The fire protection can also be deployed on the roof of the structure, for example in a horizontally unrolled form, prior to the structure being threatened by a wildfire, and then the fire protection curtain can be deployed through a single cable pull to protect the structure once the structure is actually threatened. For example, an exemplary method can include providing fire protection curtain 100 in a ready stage, in which the curtain is raised onto the structure, such as in folded condition, retracted over itself but extending horizontally around the roof. Information on the wildfire can be monitored, and the fire protection curtain 100 can be deployed from the ready stage to protect structure 150, such as by unfurling the curtain 100 over the structure and securing it in a fully deployed condition, in response to a determination that the threat posed by the wildfire has become sufficiently elevated. The determination of the threat level can depend, for instance, on current and predicted weather conditions, the position of the wildfire, and fuel characteristics (e.g., dry wood, wet wood etc.), prevailing winds, local geography, and historical wildfire patterns.

The exemplary fire curtain 100 can be used to cover a portion or side of an object, such as building 150 as shown for example in FIG. 7B in which one or more sides, but fewer than all sides, are covered, but the remaining side(s) are exposed, and uncovered by the curtain. For example, if a wildfire is approaching or threatening the structure 150 from a particular direction, then the curtain 100 may be deployed to protect the side facing that particular direction, without covering other side(s) of the structure that face other directions. Thus, the curtain 100 may require minimal materials and cost to protect a structure 150 from an approaching fire. While FIG. 7B shows a curtain 100 that is anchored via an anchoring arrangement 705 to protect a side of a structure 150, the curtain may be deployed or suspended using other support arrangements.

Preferably, the system can be configured so that minimal, inexpensive, equipment is required to deploy and to remove and repack the fire protection curtain, and it can preferably be installed directly by the owner of the structure 150 without the need for trained professionals. Once the threat of a wildfire has passed, fire protection curtain 100 can be taken down from the structure 150 rolled up, and reused in case of an additional threat of a wildfire.

Figure 9:
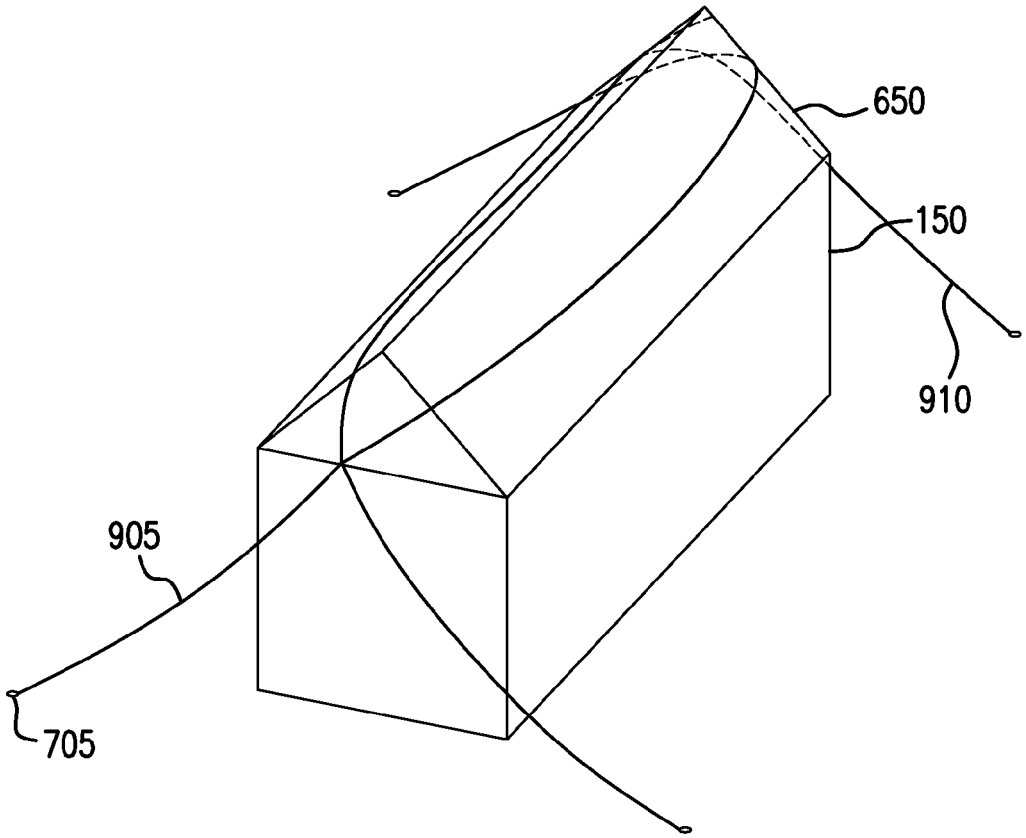
FIG. 9 shows an alternative embodiment for securing the fire protection curtain on to the roof of a structure.

FIG. 8 shows an arrangement of upper support 605 on an L-Shaped building, and FIG. 9 shows an alternative arrangement thereof including cables 905 and 910 that extend around one side of a gabled roof and anchored to the ground on an opposite side. Other arrangements of supports can be employed, including smaller versions which can protect smaller structures such as utility poles.

Figure 11:
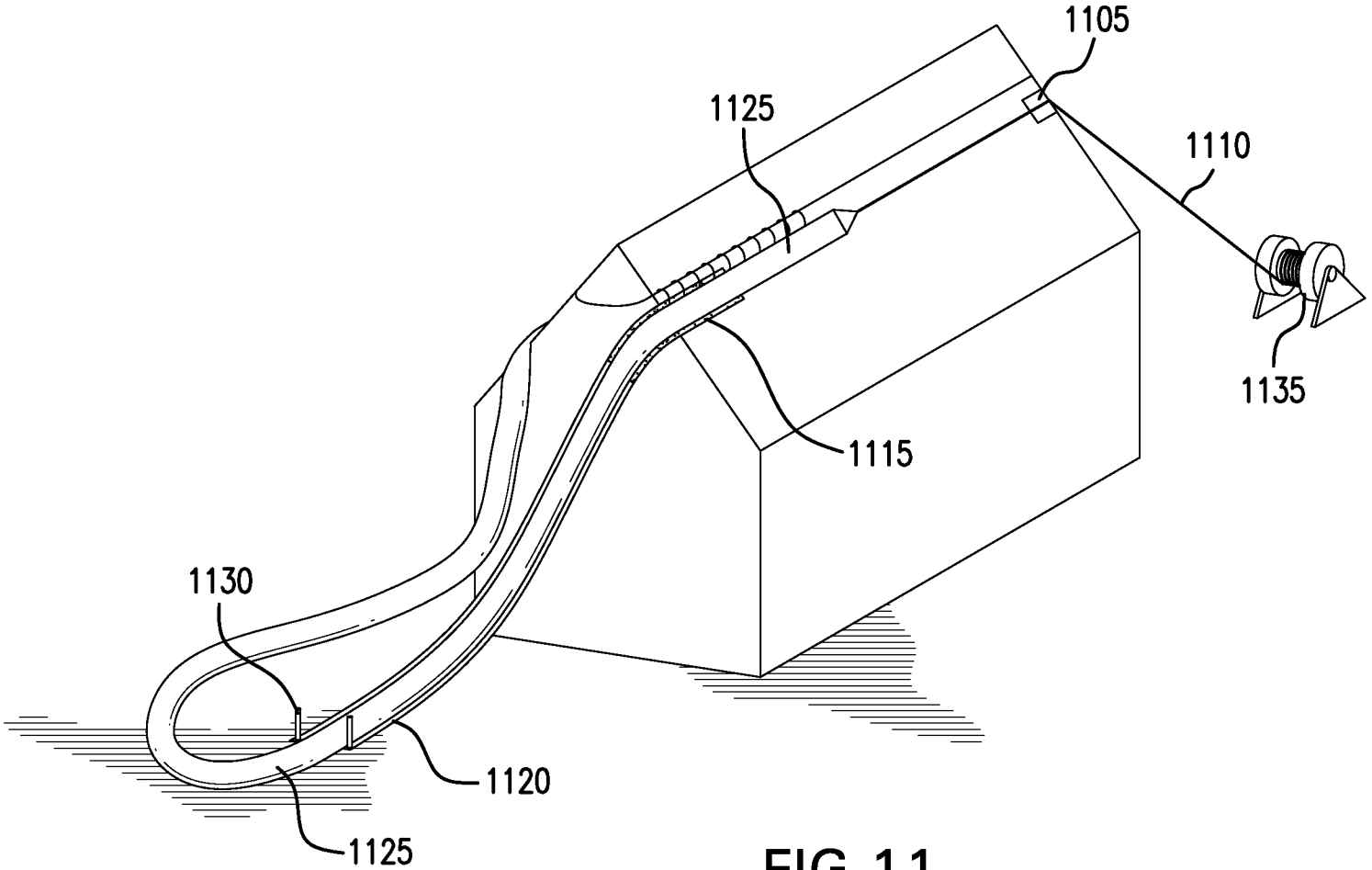
FIG. 11 shows a fire protection curtain being installed on a roof of a structure using a drag lift.

FIG. 11 shows an alternative arrangement thereof for deploying fire protection curtain 100 using a drag-lift. Fire protection curtain 100 can be unrolled from the storage roll directly from the main storage of a trailer or other vehicle, and optionally be kept in a sheath. The leading edge of fire protection curtain 100 can be attached to a pull cable 1110, which can originate on the opposite horizontal side of the structure to be protected. The cable can be pulled, winched (e.g., using winch 1135), manually or powered, pulling the fire protection curtain 100 (e.g., rolled fire protection curtain 1125) up the ramp, and over the roof. A corner support 1115 (e.g., a rigid corner support having rollers) may optionally be placed on edges, including corners and other edges for example, of the roof to help support fire protection curtain 100 and keep it from snagging to facilitate getting fire protection curtain 100 over the edge of the structure. Edge protector 1105 may also be used to protect edges or corners. As the curtain 100 passes over the corner support, it can be clipped to the support cable to hang therefrom and slide there along while it is pulled along the roof until it runs the full length of the roof of the structure. The remaining portion of fire protection curtain 100 on the main storage wheel can optionally be unrolled and spread on the ground. The tail end of fire protection curtain 100, which would now be on the opposite side of the roof peak, and can be raised by a similar process on the other side of the roof, preferably until the tail end of curtain 100 meets with the leading end on the far side of the structure and the ends can be joined or overlapped. Other methods of pulling or pushing the curtain along the support cable on the roof can be employed.

Figure 12:
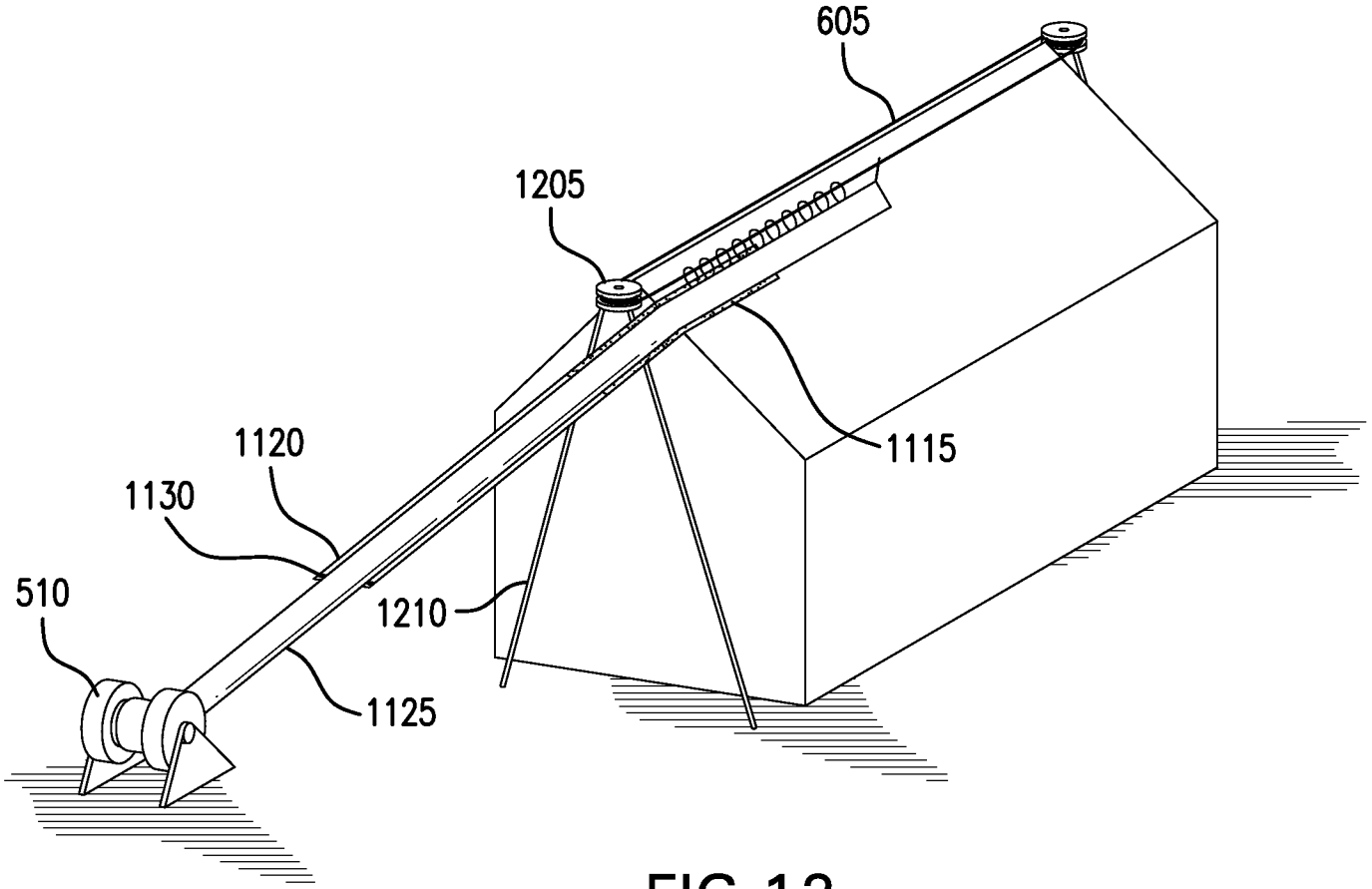
FIG. 12 shows a fire protection curtain being installed on a roof of a structure with a motion similar to a ski chairlift.

FIG. 12 shows an alternative arrangement thereof for deploying fire protection curtain 100 similar to a ski chair lift. Fire protection curtain 100 can be pulled onto and then progressively around the roof of a structure using a cable wheel 1205 having a wheel support 1210, and optionally employing a ramp 1120. The curtain 100 can be affixed to the support cable, and the cable is fed around the pulleys shown until the curtain surrounds the roof horizontally. Once fire protection curtain 100 has been deployed around the roof of the structure, it can be vertically unrolled or unfolded over the structure to protect the structure from an encroaching fire. Alternatively, the curtain can be preattached to the support cable before it is fed around the roof.

Figure 18A:
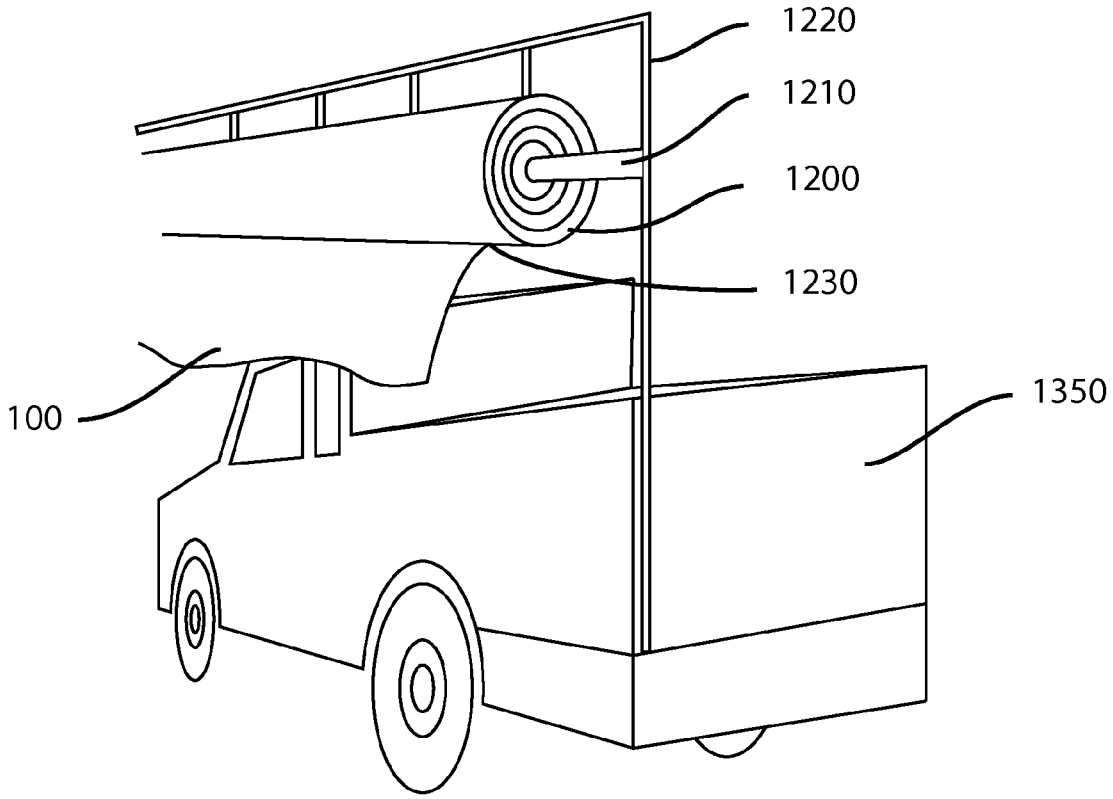
FIG. 18A shows a fire protection curtain in a furled configuration within a pipe.
Figure 18B:
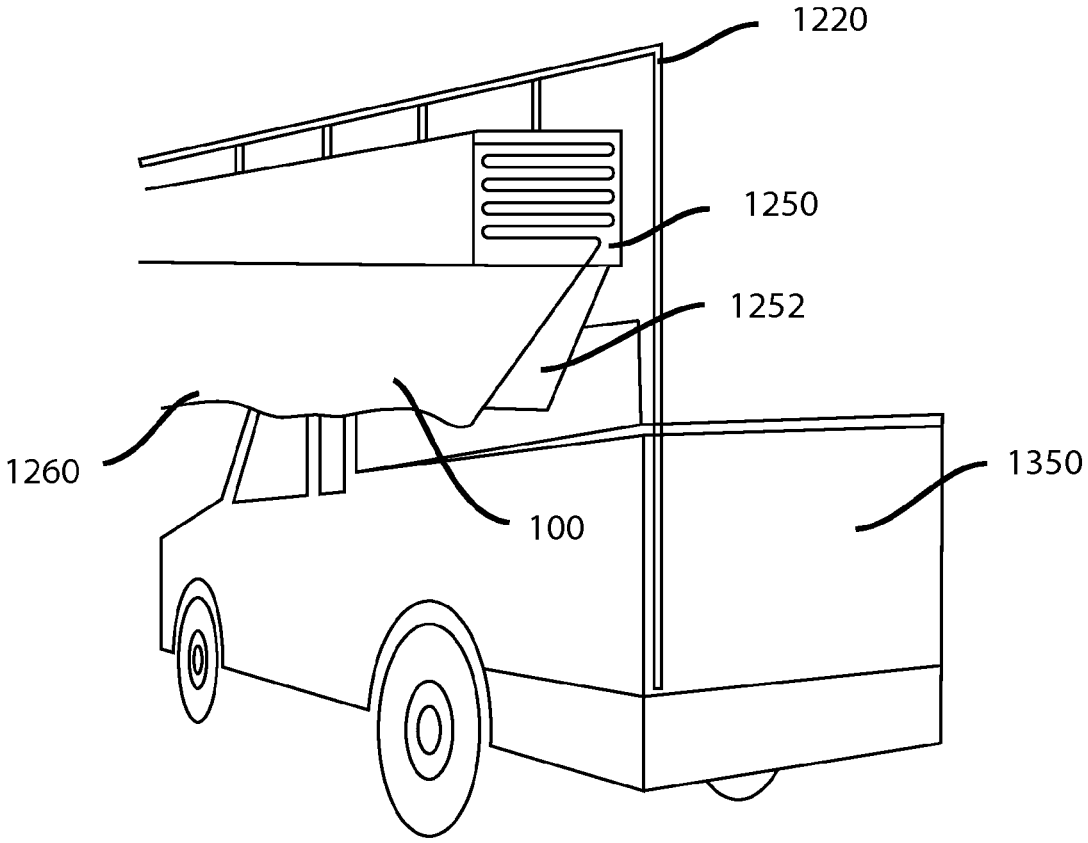
FIG. 18B shows a fire protection curtain in a furled configuration within a rectangular enclosure.

Now turning to FIGS. 18A and 18B, for any of the embodiments or structures herein described, the curtain 100 may furled within an enclosure, such as a pipe 1200, box, or a rectangular housing 1250. For example, as shown in FIG. 18A, the curtain 100 may be provided in the compact, storage configuration, such as furled pipe 1200 that is attached a support (e.g., 1220) of the structure and pulled down through an opening 1230 along the bottom along the length of the pipe 1200. As shown in FIG. 18B, in some embodiments, the curtain 100 may be furled (e.g., rolled or folded) within an enclosure (e.g., a rectangular enclosure) 1250 that is fixed to an upper portion of the structure and which includes an access door 1252. Upon opening the access door 1252, the curtain 100 may descend from the enclosure 1250 so to cover the structure. In some embodiments, a user may pull on the curtain to unfurl the curtain from its furled configuration. In some embodiments, a bottom edge 1260 of the curtain may descend from the enclosure, while the top edge of the curtain remains fixed to the enclosure, so that the curtain covers the structure. For example, the bottom edge 1260 of the curtain may be weighted to facilitate it in falling from enclosure 1250 upon opening the access door 1252.

While FIGS. 18A and 18B show a structure that is a vehicle 1350, the curtain 100 may be furled within a pipe 1220 or rectangular enclosure 1250 that is mounted to or above other type of suitable structure. For example, the pipe 1220 or rectangular enclosure 1250 may be mounted to an upper portion of a fence 1450 (see FIGS. 14A and 14B), to a support (e.g., 1370) over a pile of wood 1650 (see FIGS. 17A and 17B), etc.

Figure 13A:
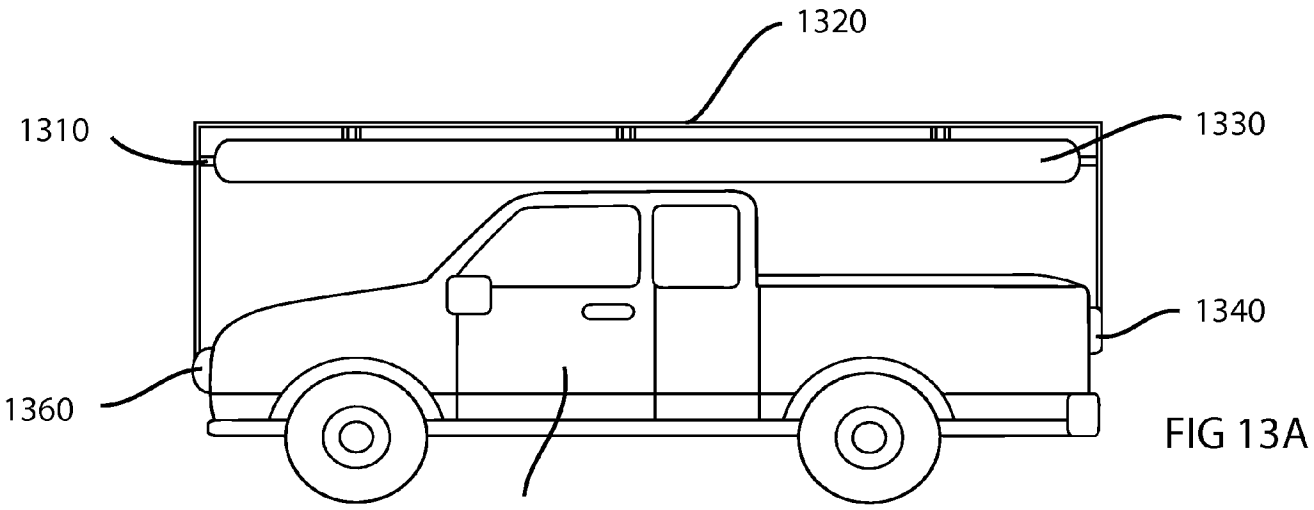
FIG. 13A shows a fire protection curtain and support installed on a vehicle in a furled configuration.

FIG. 13A shows a fire protection curtain 1330 deployed (e.g., mounted) on a vehicle (e.g., a truck) 1350 in a furled configuration. The vehicle 1350 may be an emergency vehicle, such as a fire truck or other utility truck, recreational or passenger vehicles, such as cars, buses, motorcycles, etc. As shown, the curtain 1330 may be attached to (e.g., rolled upon) mounting means 1310, such as a spool or a bar. The mounting means 1310 may be engageable with a support 1320. For example, in cases in which the mounting means 1310 comprises a spool or bar, at least one end of the spool or bar may engage the support 1320 so to support the spool/bar and curtain 1330 on the support 1320. In some embodiments, the support is a component of the vehicle 1350, such as a vehicle rack (e.g., a ladder rack or other type of vehicle rack). In some embodiments, the support 1320 is reconfigurable so to accommodate the size and/or shape of the vehicle 1350. In some embodiments, the support 1320 may attach to a front end 1360 and rear end 1340 of the vehicle so that an upper portion of the support 1320 is displaced above an upper portion of the vehicle 1350.

Figure 13B:
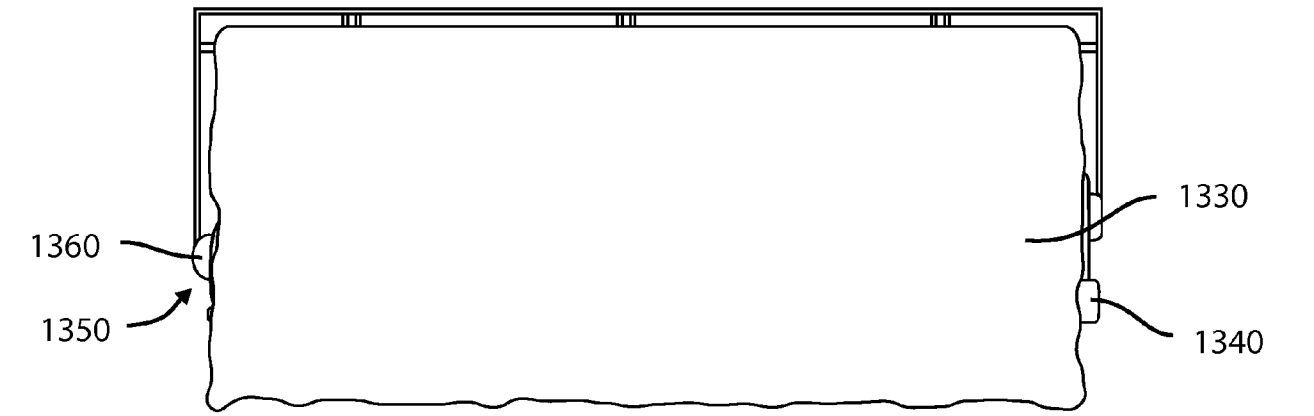
FIG. 13B shows a fire protection curtain and support installed on a vehicle in an unfurled configuration.

FIG. 13B shows the fire protection curtain 1330 mounted on the vehicle 1350 in an unfurled configuration. For cases in which the curtain 1330 is rolled upon the mounting means 1320, a user may manipulate (e.g., pull on) the curtain 1330 to unroll and thus unfurl it. In some embodiments, the curtain 1330 may be unfurled while it is mounted on mounting means 1320. In some embodiments, a user may remove some or all of the curtain 1330 from the mounting means 1320, unfurl the curtain 1330, and, in some embodiments, reattach the curtain 1330 to the mounting means 1320 in the un-furled configuration.

In the unfurled configuration, the curtain 1330 may cover a majority of the vehicle 1350. In some embodiments, the curtain 1330 may cover the front, back, left, and right sides of the vehicle 1350. In some embodiments, the curtain 1330 may cover the top of the vehicle 1350. In some embodiments, the curtain 1330 may cover less than every side of the vehicle 1350. For example, the curtain 1330 may cover the left, or right, or front, or back, or top of the vehicle 1350. The curtain 1330 may cover any number of sides of the vehicle 1350 in any combination (e.g., the left and/or right and/or front and/or back and/or top sides of vehicle 1350). The sides that are covered may be chosen based on the direction of travel of a wildfire (e.g., if the wildfire is approaching the vehicle from the eastern direction, then at least the side of the vehicle that is facing east may be covered with the curtain 1330).

Figure 14A:
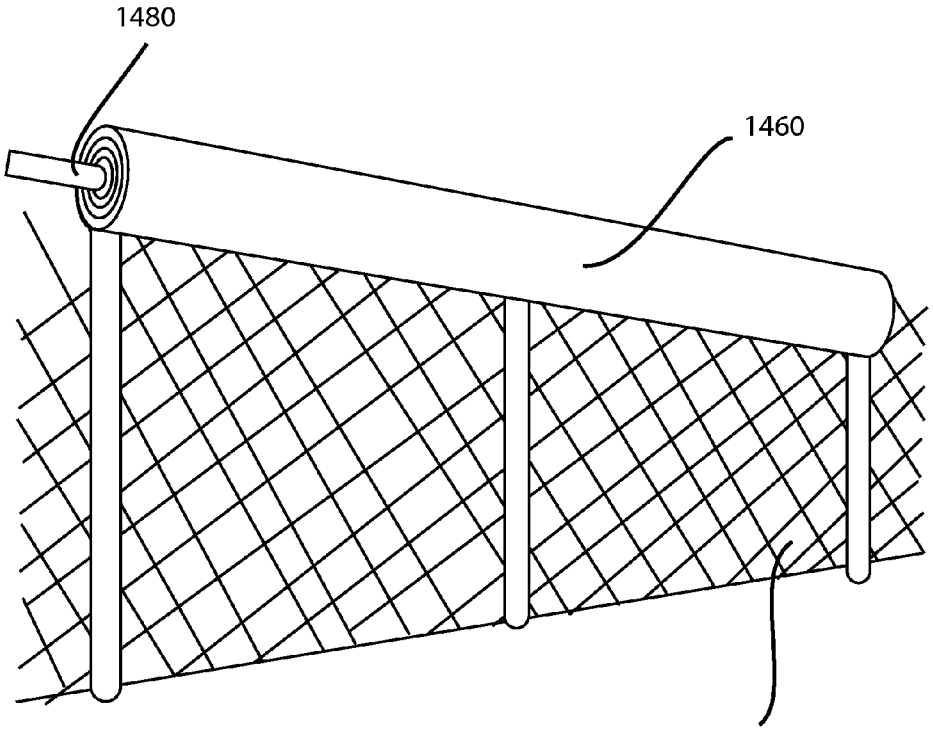
FIG. 14A shows a fire protection curtain installed on a fence in a furled configuration.

Another example of a structure that can be protected by the fire protection curtain is a fence 1450, as shown in FIG. 14A. Thus, fire protection curtain 1460 may be utilized to protect whatever objects and/or people are located beyond the fence, for example, as a wildfire approaches. Fire protection curtain 1460 can be deployed (e.g., mounted) on a fence 1450 in a furled configuration. As shown, the curtain 1460 may be attached to (e.g., rolled upon) mounting means 1480, such as a bar. The mounting means 1480 may be engageable with a support and/or with the fence 1450. For example, for cases in which the mounting means 1480 comprises a bar, at least one end of the bar may engage with the support and/or with the fence so to support the bar and curtain 1460 on the fence 1450.

Figure 14B:
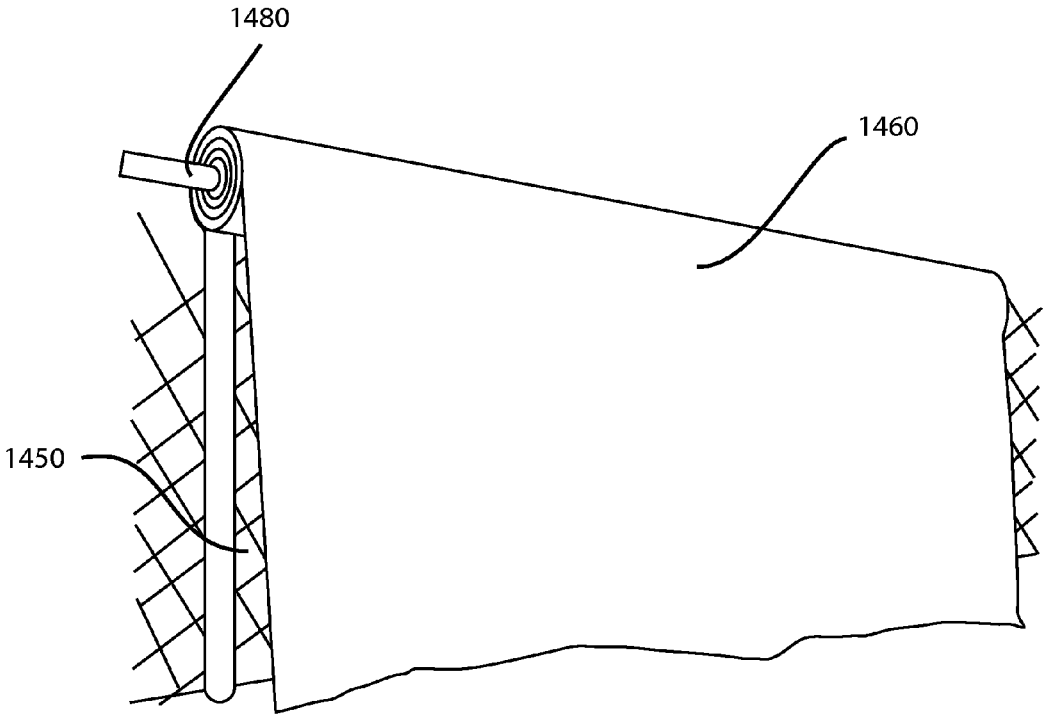
FIG. 14B shows a fire protection curtain installed on a fence in an unfurled configuration.

FIG. 14B shows the fire protection curtain 1460 deployed (e.g., mounted) on the fence 1450 in a furled configuration. In some embodiments, the curtain 1460 may be unfurled while it is mounted on mounting means 1480. In some embodiments, a user may remove some or all of the curtain 1460 from the mounting means 1480, unfurl the curtain 1460, and, in some embodiments, reattach the curtain 1460 to the mounting means 1480 in the un-furled configuration. For cases in which the curtain 1460 is rolled up upon the mounting means 1480, a user may manipulate (e.g., pull on) the curtain 1460 to unroll and thus unfurl it. In the unfurled configuration, the curtain 1460 may cover a majority of the fence 1450. In some embodiments, the curtain may be rolled or folded in a pipe that is attached to an upper portion of the structure and pulled down through an opening along the bottom along the length of the pipe. In some embodiments, the curtain may be furled (e.g., rolled or folded) within an enclosure (e.g., a rectangular enclosure) that is fixed to an upper portion of the structure and that includes an access door. Upon opening the access door, the curtain may descend from the enclosure so to cover the structure. In some embodiments, a user may pull on the curtain to unfurl the curtain from its furled configuration. In some embodiments, a bottom edge of the curtain may descend from the enclosure, while the top edge of the curtain remains fixed to the enclosure, so that the curtain covers the structure. For example, the bottom edge of the curtain may be weighted to facilitate it in falling from enclosure upon opening the access door.

Figures 15A, 15B, 15C:
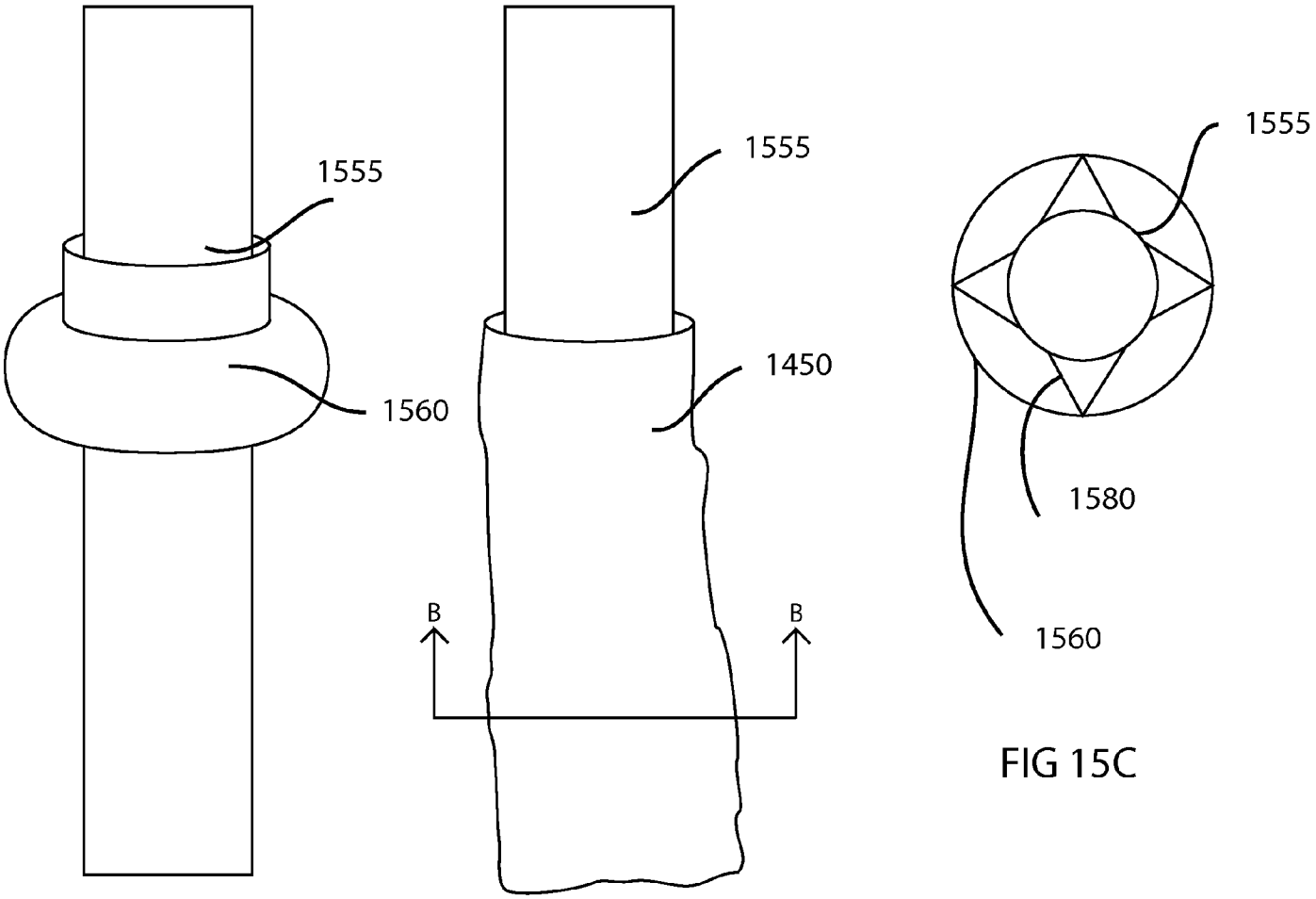
FIG. 15A shows a fire protection curtain installed on a pole in a furled configuration.
FIG. 15B shows a fire protection curtain installed on a pole in an unfurled configuration.
FIG. 15C shows a top cross-sectional view of the fire protection curtain and pole of FIG. 15, taken along line B-B.

FIG. 15A shows a fire protection curtain 1560 deployed (e.g., mounted) on a pole 1550 in a furled configuration, and FIG. 15B shows the fire protection curtain 1260 mounted on the pole 1550 in an unfurled configuration. FIG. 15C is a top cross-sectional view of the curtain 1560 and pole 1550 shown in FIG. 15B taken along line B-B. As shown, the curtain 1560 may be mounted onto the pole by way of one or more spacers 1580. For example, the one or more spacers 1580 may be mounted on the pole 1555, and the curtain 1560 may be mounted on the one or more spacers 1580. In a furled configuration, the curtain 1560 may be folded and/or bunched up so that its surface area is reduced. In an unfurled configuration, the curtain 1560 may be at least partially unfolded and/or un-bunched so that its surface area is expanded. In unfurling the curtain 1560, a user may deploy (e.g., pull on) the curtain 1560, so to unfold and/or un-bunch the curtain 1560.

Figure 16A:
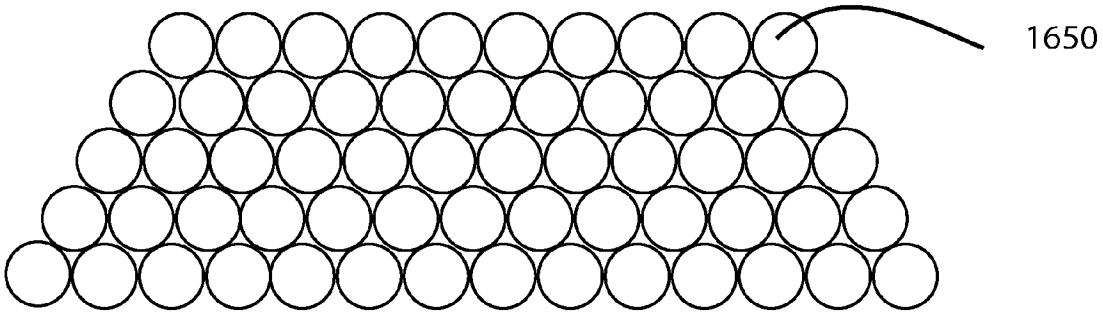
FIGS. 16A and 16B show a pile of wood.
Figure 16B:
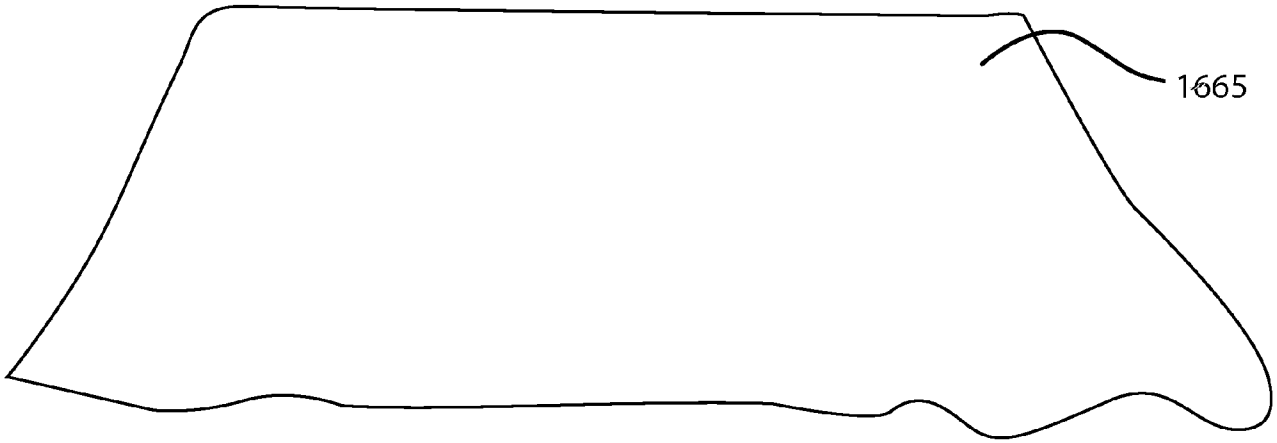

FIG. 16A shows a pile of wood 1650, and FIG. 16B shows an embodiment of a fire protection curtain 1665 disposed over the pile of wood 1650. In some embodiments, a user may deploy the curtain 1665 on the pile of wood 1650. The curtain 1665 may cover a majority of (e.g., all or substantially all of the pile of wood 1650 that is exposed to the external environment).

FIGS. 16A and 16B illustrate how a fire protection 1665 may be used to protect various objects, such as deck patio furniture, equipment, etc. Thus, a user may simply place the curtain 1665 over an object to shield a portion of the object or to protect an entire object from a fire.

Figure 17A:
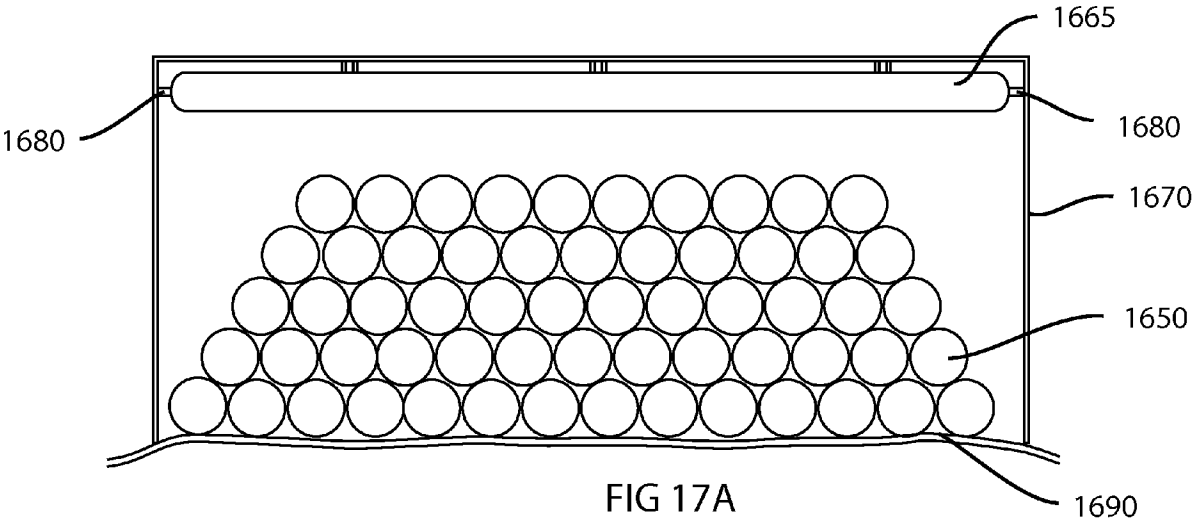
FIG. 17A shows pile of wood and an embodiment of a fire protection curtain and support in a furled configuration.

FIG. 17A shows a fire protection curtain 1665 deployed (e.g., mounted) above a pile of wood 1650 in a furled configuration. As shown, the curtain 1665 may be attached to (e.g., rolled up upon) mounting means 1680, such as a bar. The mounting means 1680 may be engageable with a support 1670. For example, for cases in which the mounting means 1680 comprises a bar, at least one end of the bar may engage with the support 1670 so to support the bar 1680 and curtain 1665 on the support 1670. In some embodiments, the support 1670 may be supported by (e.g., mounted into) the ground or a surface 1690. In some embodiments, the support 1670 is reconfigurable so to accommodate the size and/or shape of the pile of wood 1650. While a large pile of wood is referred to herein as a fixed structure, it should be apparent that a smaller, more movable pile of wood, or components thereof, would be considered a movable structure.

Figure 17B:
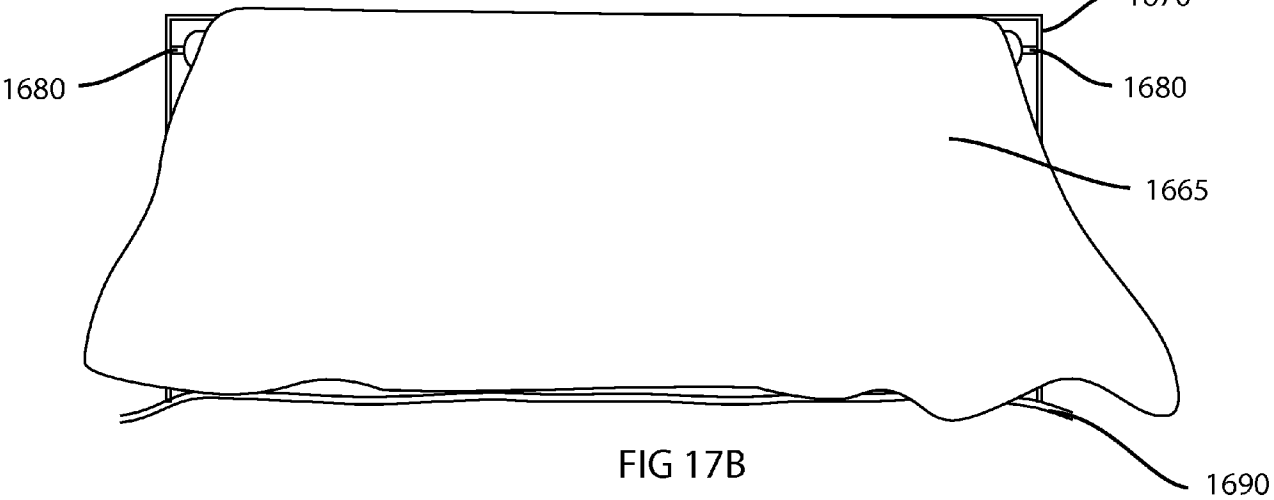
FIG. 17B shows a pile of wood and the embodiment of a fire protection curtain and support in an unfurled configuration.

FIG. 17B shows the embodiment of a fire protection curtain 1665 and support 1670 in an unfurled configuration and covering the pile of wood 1650. FIG. 17B shows the support 1670 mounted into the ground 1690 and fire protection curtain 1665 an unfurled configuration. For cases in which the curtain 1665 is rolled upon the mounting means 1680, a user may manipulate (e.g., pull on) the curtain 1665 to unroll and thus unfurl it. In the deployed configuration, the curtain 1665 may cover a majority of the pile of wood.

It will be appreciated that with regard to any of the above-described embodiments in this disclosure, the word "layer" or "sheet" may refer to a single layer or sheet of material, or it may refer to multiple layers or sheets of material. Such multiple layers or sheet may be made from a single material, or a combination of materials, as described above.

As used herein, the terms "front," "back," "upper," "lower," "side" and/or other terms indicative of direction are used herein for convenience and to depict relational positions and/or directions between the parts of the embodiments. It will be appreciated that certain embodiments, or portions thereof, can also be oriented in other positions. In addition, the term "about" should generally be understood to refer to both the corresponding number and a range of numbers. In addition, all numerical ranges herein should be understood to include each whole integer within the range.

While illustrative embodiments have been disclosed herein, it will be appreciated that numerous modifications and other embodiments may be devised by those skilled in the art. Therefore, it will be understood that the appended claims are intended to cover all such modifications and embodiments that come within the spirit and scope of the present disclosure.

What is claimed is:

1. A fire protection curtain, comprising:

a curtain panel that includes:

an outer wall, and a chimney defining an inlet disposed on a first side of the chimney and an outlet on another side of the chimney, such that heat from a source outside the outer wall is transmitted to the chimney, which heat causes the chimney to draw air into the inlet and expel the air out the outlet by chimney effect;

wherein:

the fire protection curtain is flexible and sufficiently large for covering at least a portion of a structure to protect the structure from an external fire, and the panel comprises an inner wall overlapping and spaced from the outer wall to define the chimney therebetween.

2. The fire protection curtain of claim 1, further comprising a spacing element disposed within the chimney and between the inner and outer walls to maintain a spacing therebetween and define air-channels extending therethrough for maintaining the chimney open between the inlet and outlet and maximize airflow through the chimney.

3. The fire protection curtain of claim 2, wherein;

the inner and outer walls are flexible, and the spacing element comprises a porous material having a high porosity configured to reduce restrictions to airflow, the spacing element being resiliently compressible to enable rolling of the panel and expansion of the spacing between the walls upon unfurling of the panel.

4. The fire protection curtain of claim 1, wherein the inner and outer walls are made of sheets of metal foil.

5. The fire protection curtain of claim 1, wherein the panel comprises a plurality of panels, the fire protection curtain further comprising a common vertical support from which more than one of the panels disposed vertically with respect to each other is independently supported.

6. The fire protection curtain of claim 5, wherein the vertical support comprises a cable or wire independently connected to a plurality of the panels.

7. The fire protection curtain of claim 1, wherein the inner wall comprises a thermally insulative material.

8. The fire protection curtain of claim 1, wherein the chimney is in heat conductive association with the outer wall.

9. The fire protection curtain of claim 1, wherein the inlet is on an interior of the panel, and the outlet on an exterior of the panel.

10. The fire protection curtain of claim 9, wherein:

the panel comprises a plurality of panels; and a one-way divider is provided at the top and bottom of each of the plurality of the panels of the curtain to define the inlets and outlets thereof, each one-way divider extending from the inner wall of a lower panel to an outer wall of a higher panel to define the outlet from the lower panel and the inlet of the higher panel.

11. The fire protection curtain of claim 1, wherein the structure is a fixed structure.

12. The fire protection curtain of claim 1, wherein the structure is a vehicle.

13. A method of deploying a fire protection curtain to protect a structure, comprising:

placing a support element around a peak of a roof of the structure;

hoisting the fire protection curtain up to the support element; and unfurling the hoisted fire protection curtain over the structure;

wherein the fire protection curtain comprises a plurality of curtains panels, each curtain panel comprising:

an outer wall; and an inner wall held spaced from the outer wall to define a chimney between the outer wall and the inner wall to draw air into and expel the air out of the chimney by chimney effect.

14. A method of deploying a fire protection curtain to protect a structure, comprising:

placing the fire protection curtain at an elevated position on the structure; and unfurling the fire protection curtain vertically to cover at least a side of the structure;

wherein the fire protection curtain comprises:

an outer wall; and an inner wall held spaced from the outer wall to define a chimney between the outer wall and the inner wall to draw air into and expel the air out of the chimney by chimney effect.

15. The method of claim 14, wherein the unfurling comprises unrolling or unfolding the fire protection curtain.

16. The method of claim 14, wherein the structure is a vehicle.

17. The method of claim 14, wherein the structure is a fixed structure.

* * * * *